US008452588B2

(12) United States Patent
Yamanashi et al.

(10) Patent No.: US 8,452,588 B2
(45) Date of Patent: May 28, 2013

(54) ENCODING DEVICE, DECODING DEVICE, AND METHOD THEREOF

(75) Inventors: Tomofumi Yamanashi, Kanagawa (JP); Masahiro Oshikiri, Kanagawa (JP)

(73) Assignee: Panasonic Corporation, Osaka (JP)

( * ) Notice: Subject to any disclaimer, the term of this patent is extended or adjusted under 35 U.S.C. 154(b) by 418 days.

(21) Appl. No.: 12/918,575

(22) PCT Filed: Mar. 13, 2009

(86) PCT No.: PCT/JP2009/001129

§ 371 (c)(1),
(2), (4) Date: Aug. 20, 2010

(87) PCT Pub. No.: WO2009/113316

PCT Pub. Date: Sep. 17, 2009

(65) Prior Publication Data

US 2010/0332221 A1 Dec. 30, 2010

(30) Foreign Application Priority Data

Mar. 14, 2008 (JP) ..... 2008-066202
May 30, 2008 (JP) ..... 2008-143963
Nov. 21, 2008 (JP) ..... 2008-298091

(51) Int. Cl.
*G10L 11/04* (2006.01)

(52) U.S. Cl.
USPC ..... 704/207; 704/203; 704/204; 704/205; 704/206; 704/221

(58) Field of Classification Search
USPC ..... 704/207, 205, 206, 203, 204, 215, 704/221
See application file for complete search history.

(56) References Cited

U.S. PATENT DOCUMENTS 7,246,065 B2 * 7/2007 Tanaka et al. ..... 704/500
7,848,921 B2 12/2010 Ehara
8,121,831 B2 * 2/2012 Oh et al. ..... 704/219
2003/0088328 A1 5/2003 Nishio et al.

(Continued)

FOREIGN PATENT DOCUMENTS

JP 2003-140692 5/2003
JP 2004-4530 1/2004

(Continued)

OTHER PUBLICATIONS

U.S. Appl. No. 12/936,447 to Toshiyuki Morii, filed Oct. 5, 2010.

*Primary Examiner* — Qi Han
(74) *Attorney, Agent, or Firm* — Greenblum & Bernstein, P.L.C.

(57) ABSTRACT

It is possible to improve quality of a decoding signal in a band spread for estimating a high band from a low band of a decoding signal. A first layer encoder encodes a lower band portion below a predetermined frequency of an input signal so as to generate first layer encoded information. A first layer decoder decodes the first layer encoded information so as to generate a first layer demodulated signal. A second layer encoder divides a high band portion higher, than a predetermined frequency, of an input signal into a plurality of sub-bands and estimates each of the sub-bands from the input signal or the first layer decoded signal by using the estimation result of the sub-band adjacent to the lower band side so as to generate second encoded information including the estimation results of the sub-bands.

22 Claims, 23 Drawing Sheets

U.S. PATENT DOCUMENTS

| | | | | |
|---|---|---|---|---|
| 2003/0088400 | A1 | 5/2003 | Nishio et al. | |
| 2003/0088423 | A1 | 5/2003 | Nishio et al. | |
| 2003/0142746 | A1 | 7/2003 | Tanaka et al. | |
| 2007/0011002 | A1* | 1/2007 | Chinen et al. | 704/229 |
| 2008/0027733 | A1 | 1/2008 | Oshikiri et al. | |
| 2008/0052066 | A1 | 2/2008 | Oshikiri et al. | |
| 2010/0250261 | A1* | 9/2010 | Laaksonen et al. | 704/500 |

FOREIGN PATENT DOCUMENTS

| | | |
|---|---|---|
| WO | 2005/040749 | 5/2005 |
| WO | 2005/111568 | 11/2005 |
| WO | 2006/049204 | 5/2006 |
| WO | 2008/084688 | 7/2008 |

* cited by examiner

ENCODING DEVICE, DECODING DEVICE, AND METHOD THEREOF

TECHNICAL FIELD

The present invention relates to a coding apparatus, a decoding apparatus and a method thereof used in a communication system for encoding and transmitting signals.

BACKGROUND ART

When speech or sound signals are transmitted by a packet communication system typified by internet communication, a mobile communication system and so forth, compression and coding techniques are commonly used in order to improve the efficiency of transmission of speech or sound signals. In addition, in recent years, there is an increasing need for not only a technique to simply encode speech or sound signals at a low bit rate but also a technique to encode wider band speech or sound signals.

To meet this need, various techniques for encoding wideband speech or sound signals without significantly increasing the amount of information after coding have been developed. For example, according to Patent Document 1, spectral data is obtained by converting acoustic signals inputted in a certain period of time and the characteristic of a high frequency band of this spectral data is generated as auxiliary information and outputted with encoded information of a low frequency band. To be more specific, spectral data of a high frequency band is divided into a plurality of groups, and information to specify the low frequency band spectrum most similar to the spectrum of each group is provided as auxiliary information. In addition, according to Patent Document 2, discloses a technique for dividing a high frequency band signal into a plurality of subbands, determining the degree of similarity between a signal in each subband and a low frequency band signal and modifying, depending on the determination result, the content of information (the amplitude parameter in each subband, the position parameter of the similar low frequency band signal and the signal parameter of the difference between the high frequency band and the low frequency band.

Patent Document 1: Japanese Patent Application Laid-Open No. 2003-140692

Patent Document 2: Japanese Patent Application Laid-Open No. 2004-4530

DISCLOSURE OF INVENTION

Problems to be Solved by the Invention

However, according to the above-described Patent Document 1 and Patent Document 2, in order to generate a higher frequency band signal (spectral data of a higher frequency band), a lower frequency band signal similar to the higher frequency band signal is decided individually per subband (group) of the higher frequency band signal, and therefore the efficiency of coding is not sufficient. In particular, when auxiliary information is encoded at a low bit rate, the quality of decoded speech generated using calculated auxiliary information is not satisfactory and noise may occur depending on cases.

It is therefore an object of the present invention to provide a coding apparatus, a decoding apparatus and a method of the same that make possible to efficiently encode spectral data of the higher frequency band based on spectral data of the lower frequency band of a broadband signal and improve the quality of a decoded signal.

Means for Solving the Problem

The coding apparatus according to the present invention adopts a configuration to include: a first coding section that encodes a low frequency band of an input signal equal to or lower than a predetermined frequency to generate first encoded information; a decoding section that decodes the first encoded information to generate a decoded signal; and a second coding section that generates second encoded information by dividing a high frequency band of the input signal higher than the predetermined frequency into a plurality of subbands and estimating each of the plurality of subbands based on the input signal or the decoded signal, using an estimation result from a neighboring subband.

The decoding apparatus according to the present invention adopts a configuration to include: a receiving section that receives first encoded information generated in a coding apparatus and obtained by encoding a low frequency band of an input signal equal to or lower than a predetermined frequency and second encoded information obtained by dividing a high frequency band of the input signal higher than the predetermined frequency into a plurality of subbands and estimating each of the plurality of subbands based on the input signal or a first decoded signal obtained by decoding the first encoded information using an estimation result in a neighboring subband; a first decoding section that decodes the first encoded information to generate a second decoded signal; and a second decoding section that generates a third decoded signal by estimating the high frequency band of the input signal based on the second decoded signal using the decoded result in the neighboring subband obtained by using the second encoded information.

The coding method of the present invention includes the steps of: encoding a low frequency band of an input signal equal to or lower than a predetermined frequency to generate first encoded information; decoding the first encoded information to generate a decoded signal; and generating second encoded information by dividing a high frequency band of the input signal higher than the predetermined frequency into a plurality of subbands and estimating each of the plurality of subbands using an estimation result in a neighboring subband.

The decoding method of the present invention includes the steps of: receiving first encoded information that is generated in a coding apparatus and obtained by encoding a low frequency band of an input signal lower than a predetermined frequency and second encoded information that is obtained by dividing a high frequency band of the input signal higher than the predetermined frequency into a plurality of subbands and estimating each of the plurality of subbands based on the input signal or a first decoded signal obtained by decoding the first encoded information, using an estimation result in a neighboring subband; decoding the first encoded information to generate a second decoded signal; and generating a third decoded signal by estimating the high frequency band of the input signal based on the second decoded signal, using a decoded result in the neighboring subband obtained by using the second encoded information.

Advantageous Effects of Invention

According to the present invention, in order to generate spectral data of a high frequency band of a signal to be encoded based on spectral data of a low frequency band, it is possible to efficiently encode spectral data of the high frequency band of a wideband signal and improve the quality of a decoded signal by performing coding based on the coding result in the neighboring subband, using correlation between high frequency subbands.

BEST MODE FOR CARRYING OUT THE INVENTION

Now, embodiments of the present invention will be described in detail with reference to the accompanying drawings. Here, the coding apparatus and decoding apparatus according to the present invention will be described using a speech coding apparatus and a speech decoding apparatus as examples.

Figure 1:
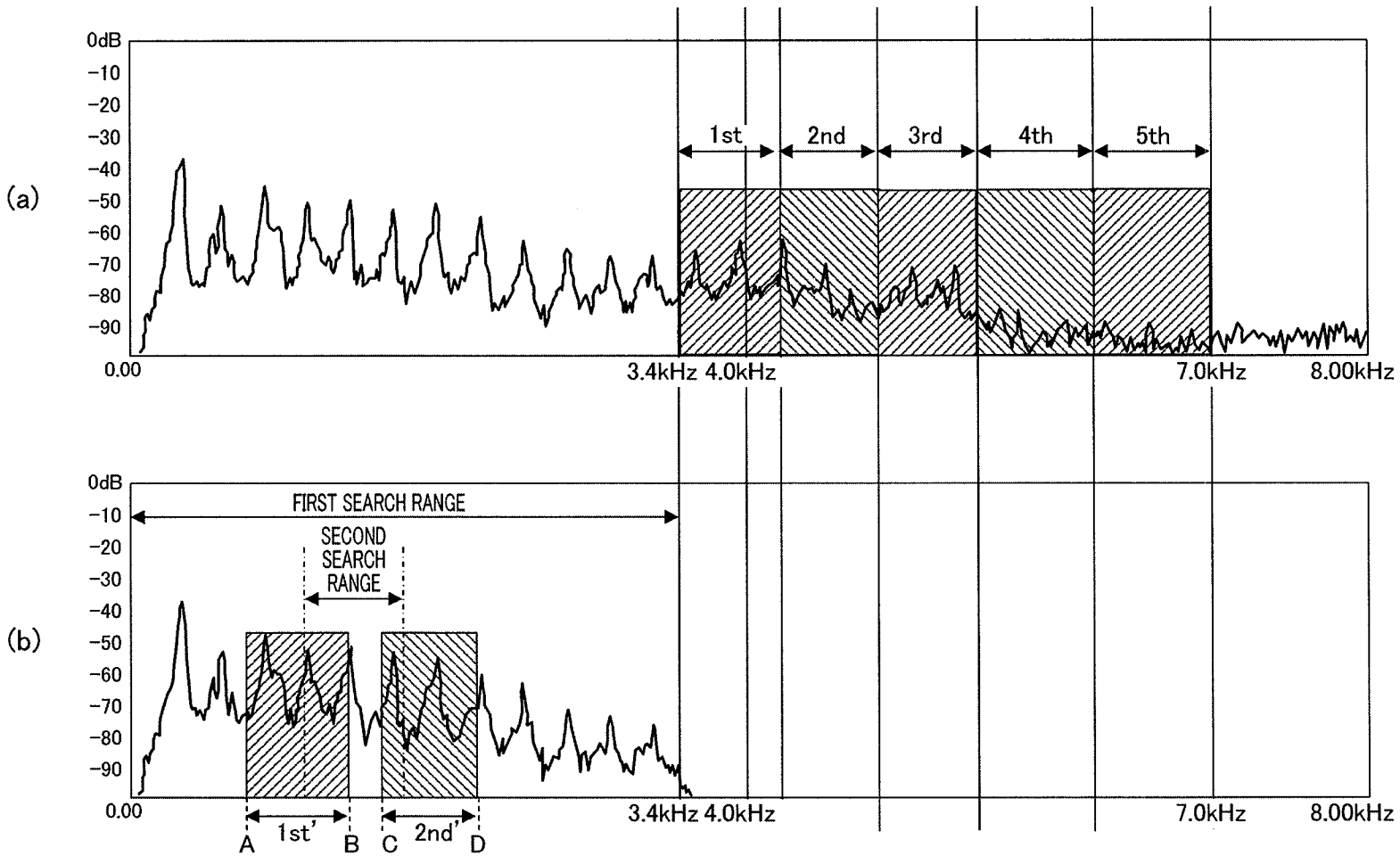
FIG. 1 is a drawing explaining a summary of a search processing included in coding according to the present invention.

First, a summary of search processing included in coding according to the present invention will be described with reference to FIG. 1. FIG. 1(*a*) shows the spectrum of an input signal, and FIG. 1(*b*) shows the spectrum (the first layer decoded spectrum) resulting from decoding encoded data of the low frequency band of an input signal. In addition, here, a case will be described as an example here signals in a frequency band for telephones (0 to 3.4 kHz) is extended to wideband signals (0 to 7 kHz). That is, the sampling frequency of an input signal is 16 kHz, and the sampling frequency of a decoded signal outputted from a low frequency band coding section is 8 kHz. Here, in order to encode the high frequency band of an input signal, the high frequency band of the input signal spectrum is divided into a plurality of subbands (composed of five subbands from 1st to 5th in FIG. 1), and the part of the first layer decoded spectrum most similar to the spectrum of the high frequency band is searched per subband.

In FIG. 1, the first search range and the second search range indicate the ranges to search for parts (bands) of decoded low frequency band spectrums (the first layer decoded spectrums described later) similar to the first subband (1st) and a second subband (2nd). Here, the first search range is, for example, from Tmin (0 kHz) to Tmax. Frequency A indicates the beginning position of band 1st', which is the part of the decoded low frequency band spectrum similar to the first subband and frequency B indicates the end of band 1st'. Next, when search with respect to the second subband (2nd) is performed, the result of search for the first subband (1st) having finished is used. To be more specific, in the range in the vicinity of the end position of part 1st' most similar to the first subband (1st), that is, in the second search range, part of the decoded low frequency band spectrum similar to the second subband (2nd) is searched. As a result of performing search for the second subband, for example, the beginning position of band 2nd', which is the part of the decoded low frequency band spectrum similar to the second subband is C and the end position is D. Search with respect to each of the third subband, fourth subband and fifth subband is performed in the same way using the result of search with respect to the previous neighboring subband. By this means, it is possible to efficiently search for similar parts using correlations between subbands, and therefore, it is possible to improve coding performance of the higher frequency band spectrum. Here, with FIG. 1, although a case has been described as an example where the sampling frequency of an input signal is 16 kHz, the present invention is not limited to this and is equally applicable to cases in which the sampling frequency of an input signal is 8 kHz, 32 kHz and so forth. That is, the present invention is not limited depending on the sampling frequency of an input signal.

(Embodiment 1)

Figure 2:
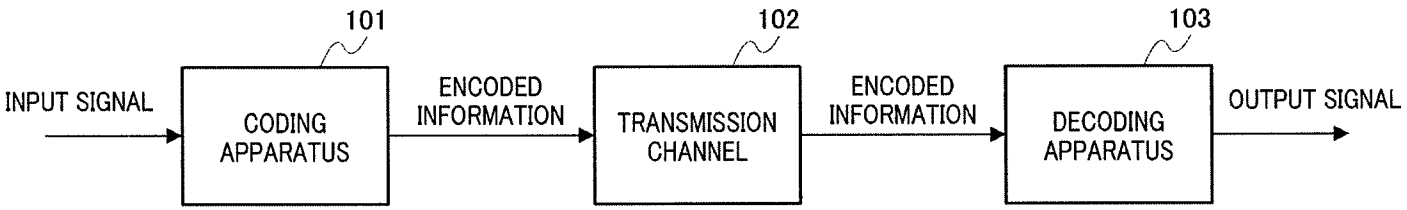
FIG. 2 is a block diagram showing a configuration of a communication system having a coding apparatus and a decoding apparatus according to Embodiment 1 of the present invention.

FIG. 2 is a block diagram showing a configuration of a communication system having a coding apparatus and a decoding apparatus according to Embodiment 1 of the present invention. In FIG. 2, the communication system has the coding apparatus and the decoding apparatus that are able to communicate with one another via a transmission channel. Here the coding apparatus and the decoding apparatus are usually mounted in a base station apparatus or a communication terminal apparatus and so forth and used.

Coding apparatus 101 divides an input signal every N samples (N is a natural number) and encodes every one frame of N samples. Here, an input signal to be encoded is represented as $x_n$ (n=0, . . . , N−1). n represents n+1th signal element of an input signal divided every N samples. The encoded input information (encoded information) is transmitted to decoding apparatus 103 via transmission channel 102.

Decoding apparatus 103 receives the encoded information transmitted from coding apparatus 101 via transmission channel 102 and decodes it to obtain an output signal.

Figure 3:
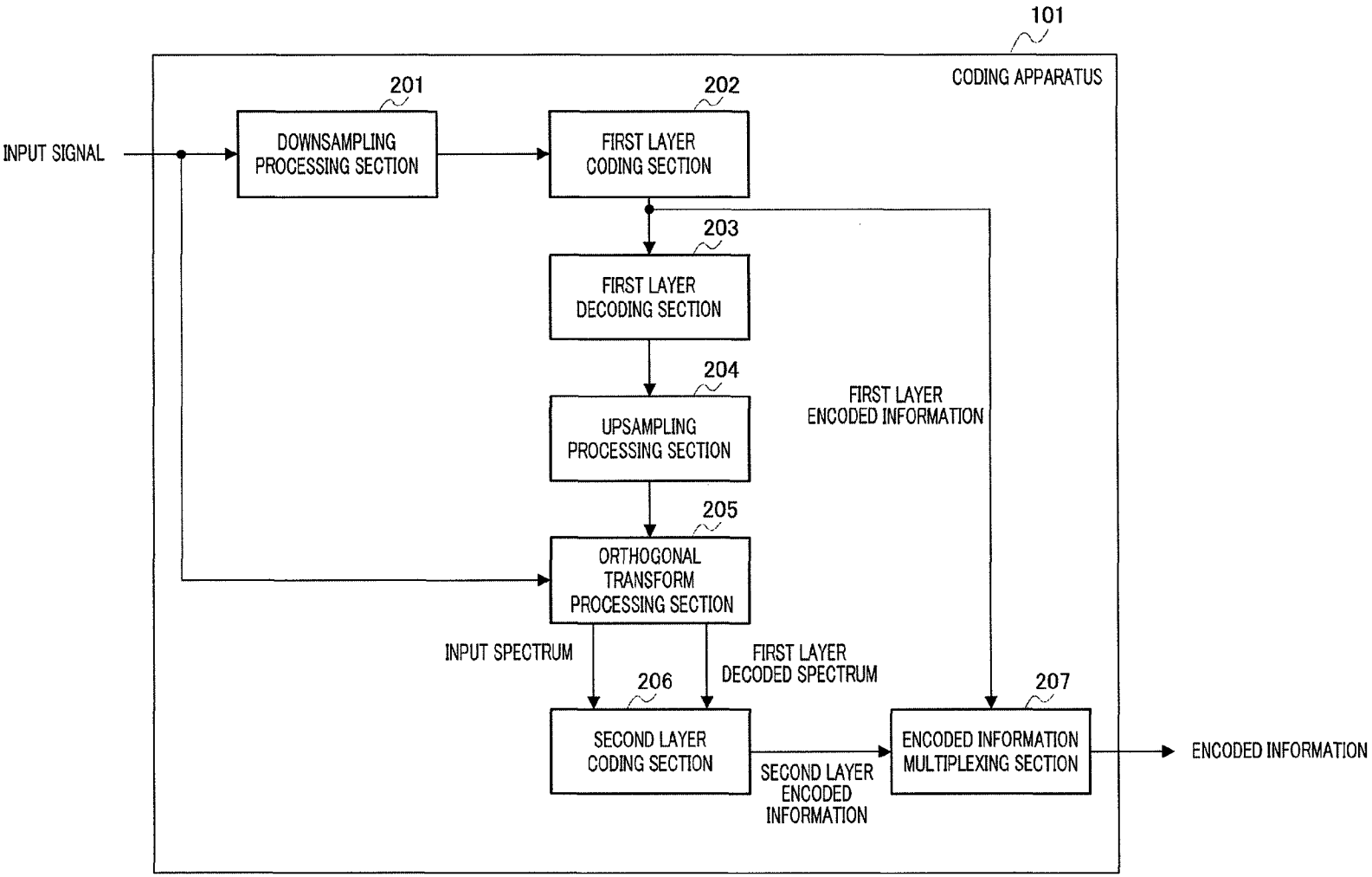
FIG. 3 is a block diagram showing primary parts in the coding apparatus shown in FIG. 2.

FIG. 3 is a block diagram showing primary parts in coding apparatus 101 shown in FIG. 2. If the sampling frequency of an input signal is $SR_{input}$, downsampling processing section 201 dawnsamples the sampling frequency of the input signal from $SR_{input}$ to $SR_{base}$ ($SR_{base}<SR_{input}$) and outputs the downsampled input signal to first layer coding section 202 as an input signal after downsampling.

First layer coding section 202 encodes the input signal after downsampling inputted from downsampling processing section 201, using, for example, a CELP (Code Excited Linear Prediction) speech coding method to generate first layer encoded information and outputs the generated first layer encoded information to first layer decoding section 203 and encoded information multiplexing section 207.

First layer decoding section 203 decodes the first layer encoded information inputted from first layer coding section 202, using, for example, a CELP speech decoding method to generate a first layer decoded signal and outputs the generated first layer decoded signal to upsampling processing section 204.

Upsampling processing section 204 upsamples the sampling frequency of the first layer decoded signal inputted from first layer decoding section 203 from $SR_{base}$ to $SR_{input}$ and outputs the upsampled first layer decoded signal to orthogonal transform processing section 205 as a first layer decoded signal after upsampling.

Orthogonal transform processing section 205 has inside buffers $buf1_n$ and $buf2_n$ (n=0, . . . , N−1) and performs modified discrete cosine transform (MDCT) on input signal $x_n$ and upsampled first layer decoded signal $y_n$ inputted from upsampling processing section 204.

Next, as for orthogonal transform processing in orthogonal transform processing section 205, its calculation steps and data output to the internal buffer will be described.

Orthogonal transform processing section 205, first, initializes each of buffer $buf1_n$ and buffer $buf2_n$ with the initial value "0" according to following equation 1 and equation 2.

[1]

$$buf1_n=0\ (n=0, \ldots, N-1) \quad \text{(Equation 1)}$$

[2]

$$buf2_n=0\ (n=0, \ldots, N-1) \quad \text{(Equation 2)}$$

Next, orthogonal transform processing section 205 performs MDCT on input signal $x_n$ and upsampled first layer decoded signal $y_n$ according to following equation 3 and equation 4 and calculates MDCT coefficient S2($k$) of input signal $x_n$ (hereinafter "input spectrum") and MDCT coefficient S1($k$) of upsampled first layer decoded signal $y_n$ (hereinafter "first layer decoded spectrum").

[3]

$$S2(k) = \frac{2}{N}\sum_{n=0}^{2N-1} x'_n \cos\left[\frac{(2n+1+N)(2k+1)\pi}{4N}\right] \quad \text{(Equation 3)}$$

$$(k = 0, \ldots, N-1)$$

[4]

$$S1(k) = \frac{2}{N}\sum_{n=0}^{2N-1} y'_n \cos\left[\frac{(2n+1+N)(2k+1)\pi}{4N}\right] \quad \text{(Equation 4)}$$

$$(k = 0, \ldots, N-1)$$

Here, k represents the index for each sample in one frame. Orthogonal transform processing section 205 calculates vector $x_n'$ resulting from combining input signal $x_n$ and buffer $buf1_n$ according to following equation 5. In addition, orthogonal transform processing section 205 calculates $y_n'$, which is a vector resulting from combining upsampled first layer decoded signal $y_n$ and buffer $buf2_n$, according to following equation 6.

[5]

$$x'_n = \begin{cases} buf1_n & (n = 0, \ldots N-1) \\ x_{n-N} & (n = N, \ldots 2N-1) \end{cases} \quad \text{(Equation 5)}$$

[6]

$$y'_n = \begin{cases} buf2_n & (n = 0, \ldots N-1) \\ y_{n-N} & (n = N, \ldots 2N-1) \end{cases} \quad \text{(Equation 6)}$$

Next, orthogonal transform processing section 205 updates buffer $buf1_n$ and buffer $buf2_n$ according to following equation 7 and equation 8.

[7]

$$buf1_n=x_n\ (n=0, \ldots N-1) \quad \text{(Equation 7)}$$

[8]

$$buf2_n=y_n\ (n=0, \ldots N-1) \quad \text{(Equation 8)}$$

Then, orthogonal transform processing section 205 outputs input spectrum S2($k$) and first layer decoded spectrum S1($k$) to second layer coding section 206.

Second layer coding section 206 generates second layer encoded information using input spectrum S2($k$) and first layer decoded spectrum S1($k$) inputted from orthogonal transform processing section 205 and outputs the generated second layer encoded information to encoded information multiplexing section 207. Here, second layer coding section 206 will be described in detail later.

Encoded information multiplexing section 207 multiplexes first layer encoded information inputted from first layer coding section 202 and second layer encoded information inputted from second layer coding section 206, and, if necessary, adds a transmission error code and so forth to the multiplexed information source code, and outputs the result to transmission channel 102 as encoded information.

Next, primary parts in second layer coding section 206 shown in FIG. 3 will be described with reference to FIG. 4.

Second layer coding section 206 has band dividing section 260, filter state setting section 261, filtering section 262, searching section 263, pitch coefficient setting section 264, gain coding section 265 and multiplexing section 266, and these sections perform the following operations, respectively.

Band dividing section 260 divides the higher frequency band (FL≦k<FH) of input spectrum S2(*k*) inputted from orthogonal transform processing section 205 into P subbands $SB_p$(p=0, 1, . . . , P−1). Then, band dividing section 260 outputs bandwidth $BW_p$(p=0, 1, . . . , P−1) and first index $BS_p$(p=0, 1, . . . , P−1)(FL≦$BS_p$<FH) of each divided subband to filtering section 262, searching section 263 and multiplexing section 266 as band division information. Hereinafter, part corresponding to subband $SB_p$ in input spectrum S2(*k*) is referred to as subband spectrum $S2_p(k)$ ($BS_p$≦k<$BS_p$+$BW_p$).

Filter state setting section 261 sets first layer decoded spectrum S1(*k*)(0≦k<FL) inputted from orthogonal transform processing section 205 as the filter state to use in filtering section 262. First layer decoded spectrum S1(*k*) is stored in the band of 0≦k<FL of spectrum S(k) of all frequency bands of 0≦k<FH in filtering section 262 as a filter internal state (filter state).

Filtering section 262 has a multi-tap pitch filter and filters the first layer decoded spectrum based on a filter state set by filter state setting section 261, a pitch coefficient inputted from pitch coefficient setting section 264 and band division information inputted from band dividing section 260, to calculate estimation value $S2_p'(k)$($BS_p$≦k<$BS_p$+$BW_p$)(p=0, 1, . . . , P−1) for each subband $SB_p$(p=0, 1, . . . , P-1) (hereinafter "estimated spectrum" of subband $SB_p$). Filtering section 262 outputs estimated spectrum $S2_p'(k)$ of subband $SB_p$ to searching section 263. Here, filtering processing on filtering section 262 will be described in detail later. Here, the number of taps of the multi-tap may correspond to any value (integer) equal to or more than one.

Searching section 263 calculates the degree of similarity between estimated spectrum $S2_p'(k)$ of subband $SB_p$ inputted from filtering section 262 and each subband spectrum $S2_p(k)$ in the higher frequency band (FL≦k<FH) of input spectrum S2(*k*) inputted from orthogonal transform processing section 205, based on band division information inputted from band dividing section 260. This calculation of the degree of similarity is performed by, for example, correlation computation. In addition, processing in filtering section 262, processing in search for section 263 and processing in pitch coefficient setting section 264 constitute closed-loop search processing for each subband. In each closed-loop, searching section 263 calculates the degree of similarity corresponding to each pitch coefficient by varying pitch coefficient T inputted from pitch coefficient setting section 264 to filtering section 262. Searching section 263 calculates optimal pitch coefficient $T_p'$ (in the range from Tmin to Tmax) providing the maximum degree of similarity in the closed-loop for each subband, for example, the closed-loop for subband $SB_p$, and outputs P maximum pitch coefficients to multiplexing section 266. Searching section 263 calculates part of the first layer decoded spectrum band similar to each subband $SB_p$ using each optimal pitch coefficient $T_p'$. In addition, searching section 263 outputs estimated spectrum $S2_p'(k)$ for each optimal pitch coefficient $T_p'$ (p=0, 1, . . . , P−1), to gain coding section 265. Here, search processing of optimal pitch coefficient $T_p'$ (p=0, 1, . . . , P−1) in search for section 263 will be described in detail later.

When performing closed-loop search processing for first subband $SB_0$ with filtering section 262 and searching section 263 under the control of searching section 263, pitch coefficient setting section 264 sequentially outputs pitch coefficient T to filtering section 262 by changing pitch coefficient T little by little in a predetermined search range from Tmin to Tmax. In addition, when performing closed-loop search processing for subband $SB_p$(p=1, 2, . . . , P−1) subsequent to the second subband with filtering section 262 and searching section 263 under the control of searching section 263, pitch coefficient setting section 264 sequentially outputs pitch coefficient T to filtering section 262 by changing pitch coefficient T little by little based on optimal pitch coefficient $T_{p-1}'$ calculated in the closed-loop search processing for subband $SB_{p-1}$. To be more specific, pitch coefficient setting section 264 outputs pitch coefficient T shown in following equation 9 to filtering section 262. In equation 9, SEARCH represents the range to search (the number of entries to search) for pitch coefficient T for subband $SB_p$.

[9]

$$T_{p-1}'+BW_{p-1}-\text{SEARCH}/2 \leqq T \leqq T_{p-1}'+BW_{p-1}+\text{SEARCH}/2 \quad \text{(Equation 9)}$$

As shown in equation 9, the range to search for pitch coefficient T for subband $SB_p$ (p=1, 2, . . . , P−1) subsequent to the second subband is the part (±SEARCH/2) around the index ($T_{p-1}'$+$BW_{p-1}$) placed in a higher frequency band than optimal pitch coefficient $T_{p-1}'$ of subband $SB_{p-1}$ by bandwidth $BW_{p-}$. This reason is that the part similar to subband $SB_p$ neighboring subband $SB_{p-1}$ tends to neighbor a part of the first layer decoded spectrum band similar to subband $SB_{p-1}$. By performing search using this correlation between subband $SB_{p-1}$ and subband $SB_p$, it is possible to improve the efficient of search as compared to the method of performing search with respect to each subband in the search range from Tmin to Tmax on a fixed basis.

Here, the above-described method using correlation between neighboring subbands will be referred to as "adaptive degree of similarity search method (ASS)." This name is given for ease of explanation, and the name does not limit the above-described search method according to the present invention.

In addition, the harmonic structure of a spectrum tends to be gradually poor when the frequency of the band is higher. That is, the harmonic structure of subband $SB_p$ tends to be poorer than that of subband $SB_{p-1}$. Therefore, it is possible to improve the efficient of search with respect to subband $SB_p$ not by searching for the part of the first layer decoded spectrum similar to subband $SB_{p-1}$ but by searching for the part similar to subband $SB_p$ in the high frequency band side having a poorer harmonic structure. From this perspective, it is possible to describe the efficiency of the searching method according to the present embodiment.

Moreover, when the value of the range of pitch coefficient T set according to equation 9 is higher than the upper limit of the band of the first layer decoded spectrum (corresponding to the condition represented by equation 10), the range of pitch coefficient T is corrected as shown in following equation 10. In equation 10, SEARCH_MAX represents the upper limit of setting values for pitch coefficient T.

[10]

$$\text{SEARCH_MAX}-\text{SEARCH} \leqq T \leqq \text{SEARCH_MAX (if } (T_{p-1}'+BW_{p-1}+\text{SEARCH}/2>\text{SEARCH_MAX})) \quad \text{(Equation 10)}$$

In addition, when the value of the range of pitch coefficient T set according to equation 9 is higher than the lower limit of the band of the first layer decoded spectrum (corresponding to the condition represented by equation 11, the range of pitch coefficient T is corrected as shown in following equation 11. In equation 11, SEARCH_MIN represents the lower limit of setting values for pitch coefficient T.

[11]

$$0 \leqq T \leqq \text{SEARCH ((if } (T_{p-1}'+BW_{p-1}-\text{SEARCH}/2<\text{SEARCH_MIN})) \quad \text{(Equation 11)}$$

By performing processing according to above-described equation 10 and equation 11, it is possible to perform efficient coding without decreasing the number of entries in search for an optimal pitch coefficient.

Gain coding section 265 calculates gain information about the high frequency band (FL≦k<FH) of input spectrum S2(*k*) inputted from orthogonal transform processing section 205. To be more specific, gain coding section 265 divides frequency band FL≦k<FH into J subbands and calculates the spectral power of input spectrum SK2(*k*) per subband. In this case, spectral power $B_j$ of the (j+1)-th subband is represented by following equation 12.

[12]

$$B_j = \sum_{k=BL_j}^{BH_j} S2(k)^2 \quad (j = 0, \ldots, J-1) \qquad \text{(Equation 12)}$$

In equation 12, $BL_j$ represents the minimum frequency of the (j+1)-th subband and $BH_j$ represents the maximum frequency of the (j+1)-th subband. In addition, gain coding section 265 forms high frequency band estimated spectrum 2'(*k*) of the input spectrum by using estimated spectrum $S2_p'(k)$(p=0, 1, . . . , P−1) of subbands inputted from searching section 263, which are continued in the frequency domain. Then, gain coding section 265 calculates spectral power $B'_j$ of estimated spectrum S2'(*k*) for each subband according to following equation 13 in the same way as the calculation of the spectral power of input spectrum S2(*k*). Next, gain coding section 265 calculates amount of variation $V_j$ in the spectral power between input spectrum S2(*k*) and estimated spectrum S2'(*k*) per subband according to equation 14.

[13]

$$B'_j = \sum_{k=BL_j}^{BH_j} S2'(k)^2 \quad (j = 0, \ldots, J-1) \qquad \text{(Equation 13)}$$

[14]

$$V_j = \sqrt{\frac{B}{B'_j}} \quad (j = 0, \ldots, J-1) \qquad \text{(Equation 14)}$$

Then, gain coding section 265 encodes amount of variation $V_j$ and outputs an index corresponding to encoded amount of variation $VQ_j$ to multiplexing section 266.

Multiplexing section 266 multiplexes, as second layer encoded information, band division information inputted from band dividing section 260, optimal pitch coefficient $T_p'$ for each subband $SB_p$(p=0, 1, . . . , P−1) inputted from searching section 263 and the index of amount of variation $VQ_j$ inputted from gain coding section 265 and outputs the second layer encoded information to encoded information multiplexing section 207. Here, the indexes of $T_p'$ and $VQ_j$ may be directly inputted to encoded information multiplexing section 207 to multiplex with first layer encoded information in encoded information multiplexing section 207.

Next, filtering processing on filtering section 262 shown in FIG. 4 will be described in detail with reference to FIG. 5.

Filtering section 262 generates an estimated spectrum of band $BS_p$≦k<$BS_p$+$BW_p$(p=0, 1, . . . , P−1) for subband $SB_p$ (p=0, 1, . . . , P−1) using a filter state inputted from filter state setting section 261, pitch coefficient T inputted from pitch coefficient setting section 264 and band division information inputted from band dividing section 260. Filter transfer function F(z) used in filtering section 262 is represented by following equation 15.

Now, processing to generate estimated spectrum $S2_p'(k)$ of subband spectrum $S2_p(k)$ will be described using subband $SB_p$ as an example.

[15]

$$F(z) = \frac{1}{1 - \sum_{i=-M}^{M} \beta_i z^{-T+i}} \qquad \text{(Equation 15)}$$

In equation 15, T represents a pitch coefficient provided from pitch coefficient setting section 264 and $\beta_i$ represents a filter coefficient stored inside in advance. For example, the number of taps is three, candidates of filter coefficients are, for example, ($\beta_{-1}$, $\beta_0$, $\beta_1$)=(0.1, 0.8, 0.1). In addition to these, the value, ($\beta_{-1}$, $\beta_0$, $\beta_1$)=(0.2, 0.6, 0.2), (0.3, 0.4, 0.3) and so forth are appropriate. Moreover, ($\beta_{-1}$, $\beta_0$, $\beta_1$)=(0.0, 1.0, 0.0) may be possible. This means that part of the first layer decoded spectrum in the band of 0≦k<FL is directly copied to band $BS_p$≦k<$BS_p$+$BW_p$ as is in the shape of the part. In addition, M is one (M=1) in equation 15. M is an indicator for the number of taps.

First layer decoded spectrum S1(*k*) is stored in the band of 0≦k<FL of spectrum S(k) of all frequency bands in filtering section 262 as a filter internal state (filter state).

Estimated spectrum $S2_p'(k)$ of subband $SB_p$ is stored in band $BS_p$≦k<$BS_p$+$BW_p$ of spectrum S(k) by filtering processing according to the following steps. That is, frequency band spectrum S(k−T), which is T lower than k is basically substituted for $S2_p'(k)$. Here, in order to improve the smoothness of a spectrum, actually, spectrum $\beta_i$·S(k−T+i) obtained by multiplying neighboring spectrum S(k−T+i) i apart from spectrum S(k−T) by predetermined filter coefficient $\beta_i$ is added for every i and the resulting spectrum is substituted for $S2_p'(k)$. This processing is represented by following equation 16.

[16]

$$S2'_p(k) = \sum_{i=-1}^{1} \beta_i \cdot S2(k - T + i)^2 \qquad \text{(Equation 16)}$$

Estimated spectrum $S2_p'(k)$ in $BS_p$≦k<$BS_p$+$BW_p$ is calculated by performing the above-described computation in order from k=$BS_p$ with a lower frequency by changing k in the range of $BS_p$≦k<$BS_p$+$BW_p$.

The above-described filtering processing is performed by resetting S(k) to zero in the range of $BS_p$≦k<$BS_p$+$BW_p$ every time pitch coefficient T is provided from pitch coefficient setting section 264. That is, S(k) is calculated every time pitch coefficient T varies and outputted to searching section 263.

Figure 4:
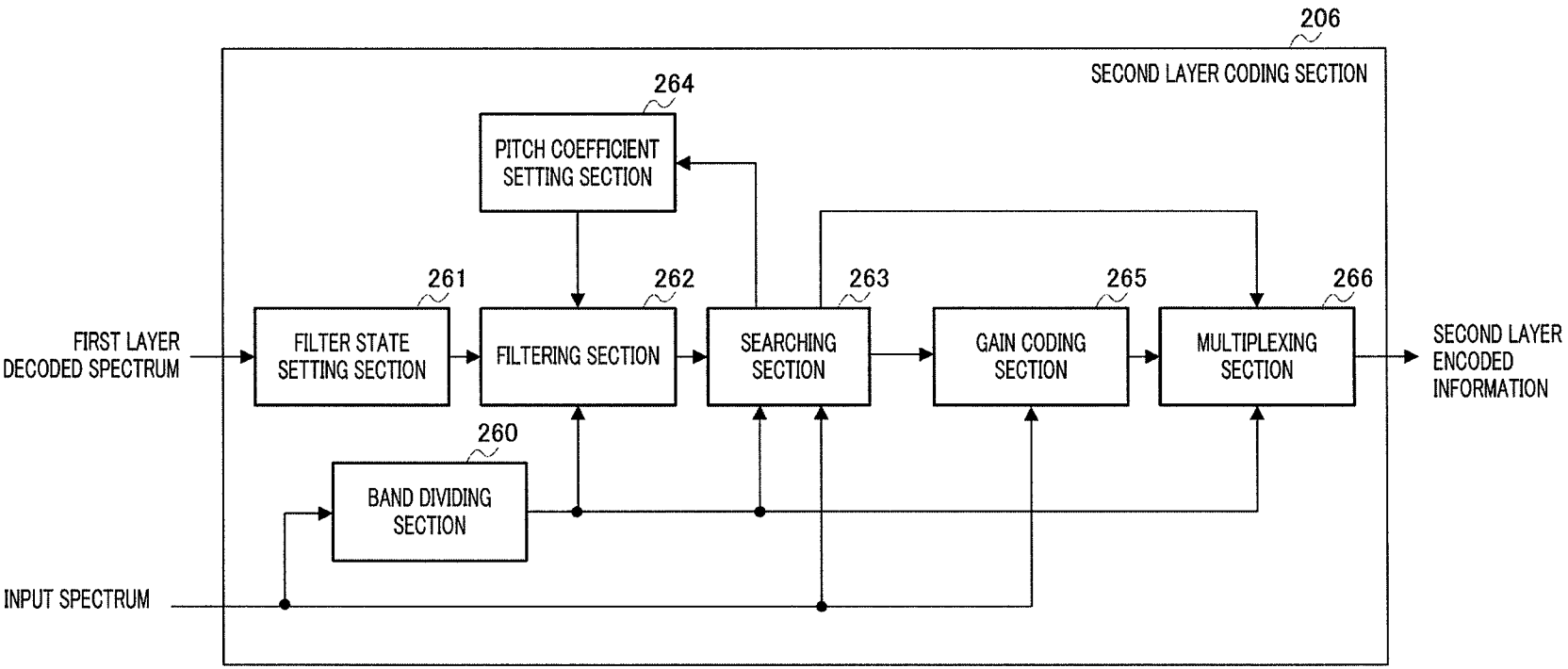
FIG. 4 is a block diagram showing primary parts in the second layer coding section shown in FIG. 3.
Figure 5:
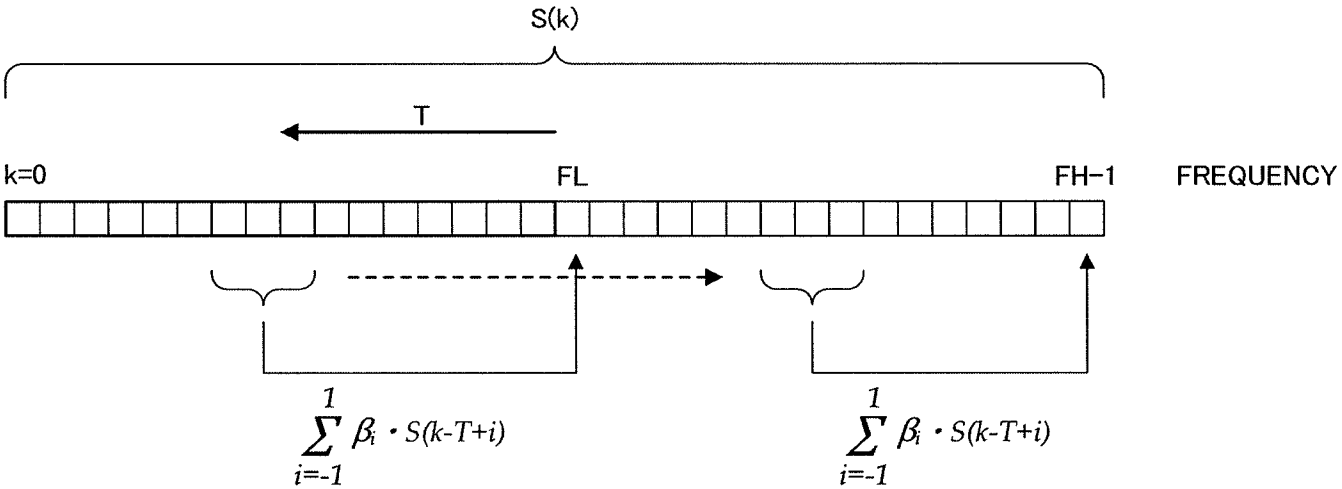
FIG. 5 is a drawing explaining in detail filtering processing in the filtering section shown in FIG. 4.
Figure 6:
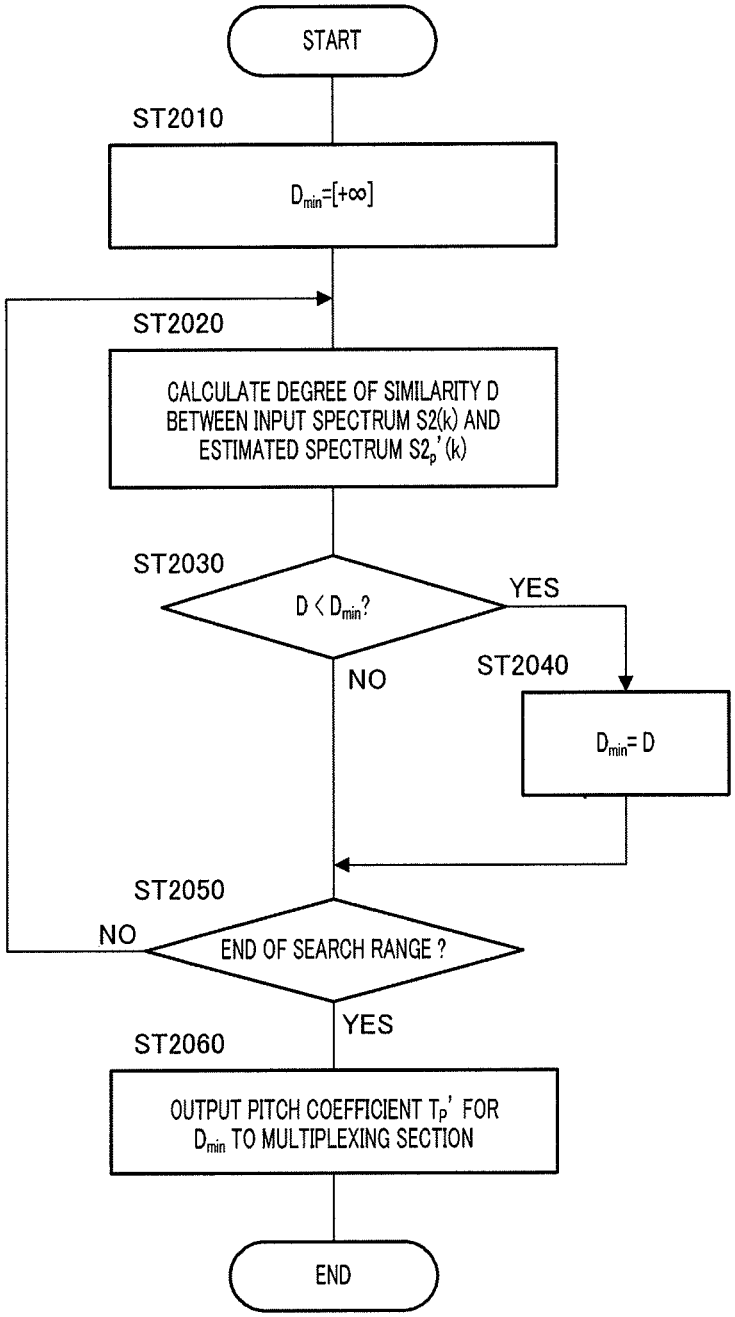
FIG. 6 is a flowchart showing steps of searching for optimal pitch coefficient $T_p'$ for subband $SB_p$ in a searching section shown in FIG. 4.

FIG. 6 is a flowchart showing steps of processing to search for optimal pitch coefficient $T_p'$ for subband $SB_p$ in searching section 263 shown in FIG. 4. Here, searching section 263 searches for optimal pitch coefficient $T_p'$ (p=0, 1, . . . , P−1) for each subband $SB_p$ (p=0, 1, . . . , P−1) by repeating steps shown in FIG. 6.

Searching section 263, first, initializes minimum degree of similarity $D_{min}$, which is a variable to save the minimum value of the degree of similarity to "+∞" (ST 2010). Next, searching section 263 calculates, with respect to a certain pitch coefficient, degree of similarity D between the higher frequency band (FL≦k<FH) of input spectrum S2(*k*) and estimated spectrum $S2_p'(k)$ according to following equation 17 (ST 2020).

[17]

$$D = \sum_{k=0}^{M'} S2(BS_p + k) \cdot S2(BS_p + k) - \frac{\left(\sum_{k=0}^{M'} S2(BS_p + k) \cdot S2'(BS_p + k)\right)^2}{\sum_{k=0}^{M'} S2'(BS_p + k) \cdot S2'(BS_p + k)} \quad (0 < M' \leq BW_p) \qquad \text{(Equation 17)}$$

In equation 17, M' represents the number of samples when degree of similarity D is calculated, and may be any value equal to or lower than the bandwidth of each subband. Here, there is no $S2_p'(k)$ in equation 17 because $S2_p'(k)$ is represented using $BS_p$ and S2'(*k*).

Next, searching section 263 determines whether or not calculated degree of similarity D is lower than minimum degree of similarity $D_{min}$ (ST 2030). When the degree of similarity calculated in ST 2020 is lower than minimum degree of similarity $D_{min}$ (ST 2030: "YES"), searching section 263 substitutes degree of similarity D for minimum degree of similarity $D_{min}$ (ST 2040). Meanwhile, when the degree of similarity calculated in ST 2020 is equal to or higher than minimum degree of similarity $D_{min}$ (ST 2030: "NO"), searching section 263 determines whether or not processing over the search range is finished. That is, searching section 263 determines, for every pitch coefficient in the search range, whether or not the degree of similarity is calculated according to above-described equation 17 in ST 2020 (ST 2050). When processing is not finished over the search range (ST 2050: "NO"), searching section 263 returns processing to ST 2020. Then, searching section 263 calculates the degree of similarity for a pitch coefficient different from the pitch coefficient calculated according to equation 17 in the previous step ST 2020. Meanwhile, when processing over the search range is finished (ST 2050: "YES"), searching section 263 outputs pitch coefficient T corresponding to minimum degree of similarity $D_{min}$ to multiplexing section 266 as optimal pitch coefficient $T_p'$ (ST 2060).

Next, decoding apparatus 103 shown in FIG. 2 will be described.

Figure 7:
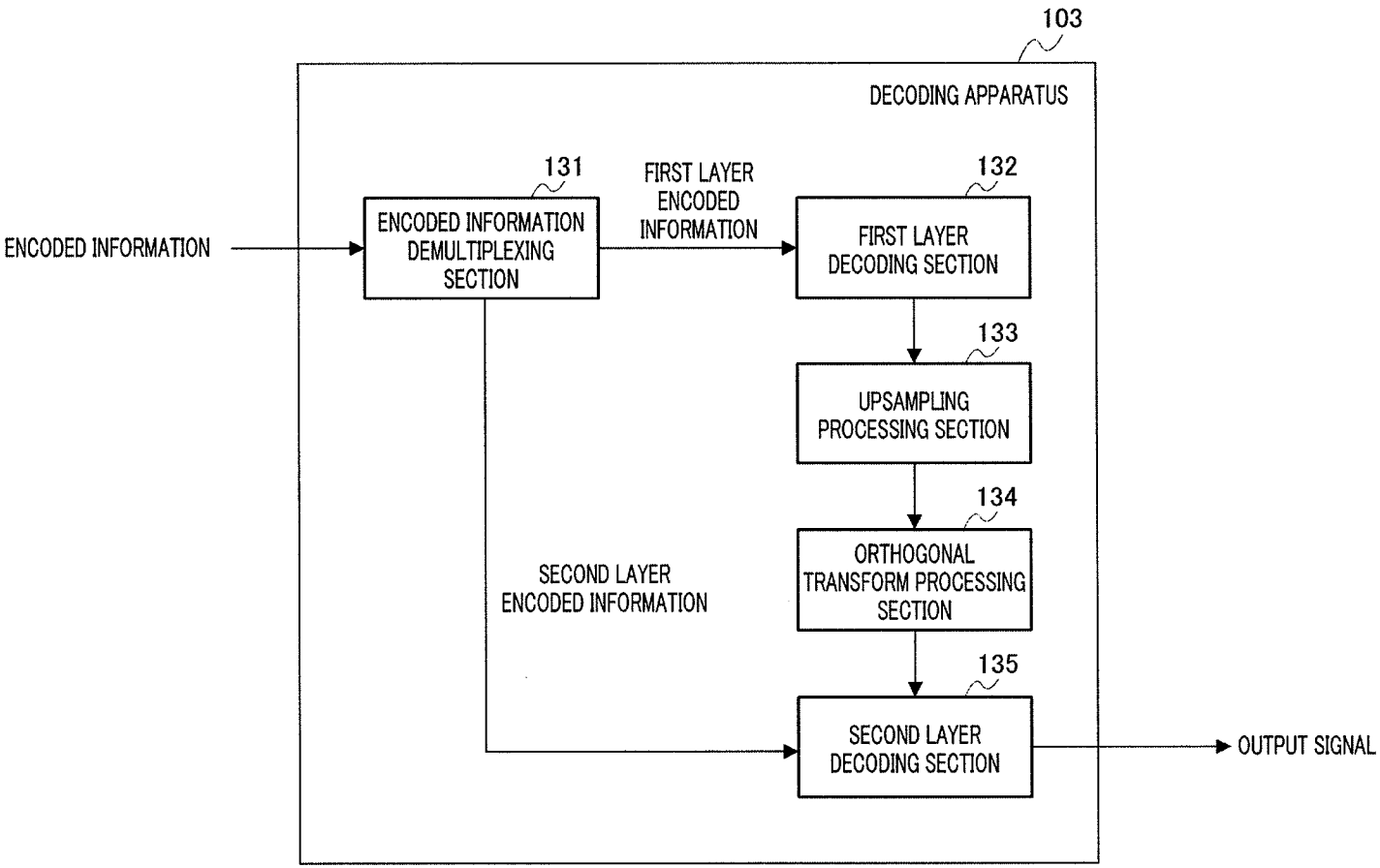
FIG. 7 is a block diagram showing primary parts in the decoding apparatus shown in FIG. 2.

FIG. 7 is a block diagram showing primary parts in decoding apparatus 103.

In FIG. 7, encoded information demultiplexing section 131 demultiplexes first layer encoded information and second layer encoded information from inputted encoded information, outputs the first layer encoded information to first layer decoding section 132 and outputs the second layer encoded information to second layer decoding section 135.

First layer decoding section 132 decodes the first layer encoded information inputted from encoded information demultiplexing section 131 and outputs a generated first layer decoded signal to upsampling processing section 133. Here, operations of first layer decoding section 132 are the same as in first layer decoding section 203 shown in FIG. 3, so that detailed descriptions will be omitted.

Upsampling processing section 133 upsamples the sampling frequency of the first layer decoded signal inputted from first layer decoding section 132 from $SR_{base}$ to $SR_{input}$ and outputs an obtained first layer decoded signal after upsampling to orthogonal transform processing section 134.

Orthogonal transform processing section 134 performs orthogonal transform processing (MDCT) on the first layer decoded signal after upsampling inputted from upsampling processing section 133 and outputs MDCT coefficient (hereinafter "first layer decoded spectrum") S1(*k*) of the obtained first layer decoded signal after upsampling to second layer decoding section 135. Here, operations of orthogonal processing section 134 are the same as processing on the first layer decoded signal after upsampling in orthogonal transform processing section 205 shown in FIG. 3, so that detailed descriptions will be omitted.

Second layer decoding section 135 generates the second layer decoded signal containing a high frequency component using first layer decoded spectrum S1(*k*) inputted from orthogonal transform processing section 134 and second layer encoded information inputted from encoded information demultiplexing section 131 and outputs the second layer decoded signal as an output signal.

Figure 8:
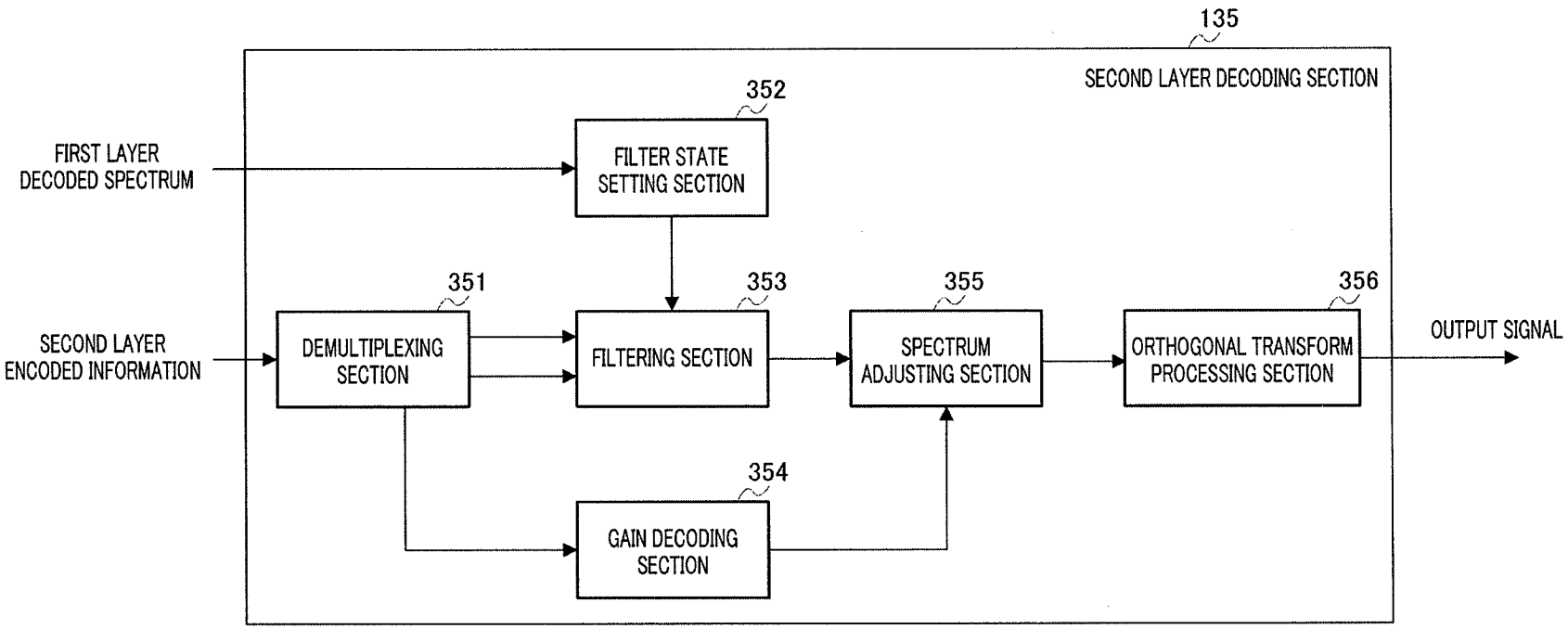
FIG. 8 is a block diagram showing primary parts in the second layer decoding section shown in FIG. 7.

FIG. 8 is a block diagram showing primary parts in second layer decoding section 135 shown in FIG. 7.

Demultiplexing section 351 demultiplexes second layer encoded information inputted from encoded information demultiplexing section 131 into band division information containing bandwidth $BW_p$(p=0, 1, . . . , P−1) and first index $BS_p$ (p=0, 1, . . . , P−1)(FL≦$BS_p$<FH) of each subband, optimal pitch coefficient $T_p'$(p=0, 1, . . . , P−1), which is information about filtering and an index of amount of variation after coding $VQ_j$ (j=0, 1, . . . , J−1), which is information about gain. In addition, demultiplexing section 351 outputs the band division information and optimal pitch coefficient $T_p'$ (p=0, 1, . . . , P−1) to filtering section 353 and outputs the index of amount of variation after coding $VQ_j$ (j=0, 1, . . . , J−1) to gain decoding section 354. Here, in a case in which encoded information demultiplexing section 131 has demultiplexed the band division information, optimal pitch coefficient $T_p'$ (p=0, 1, . . . , P−1) and the index of amount of variation after coding $VQ_j$ (j=0, 1, . . . , J−1) from each other, it is not necessary to provide demultiplexing section 351.

Filter state setting section 352 sets first layer decoded spectrum S1(*k*) (0≦k<FL) inputted from orthogonal transform processing section 134 as a filter state used in filtering section 353. Here, when the spectrum of entire frequency band of 0≦k<FH in filtering section 353 is referred to as S(k) for ease of explanation, first layer decoded spectrum S1(*k*) is stored in the band of 0≦k<FL of S(k) as a filter internal state (filter state). Here, the configuration and operations of filter setting section 352 are the same as those of filter state setting section 261 shown in FIG. 4, so that detailed descriptions will be omitted.

Filtering section 353 has a multi-tap pitch filter in which the number of taps is greater than one. Filtering section 353 filters first layer decoded spectrum S1(*k*) based on the band division information inputted from demultiplexing section 351, the filter state set by filter state setting section 352, pitch coefficient $T_p'$ (p=0, 1, . . . , P−1) inputted from demultiplexing section 351 and a filter coefficient stored inside in advance, and calculates estimation value $S2_p'$ (k) ($BS_p$≦k<$BS_p$+$BW_p$)(p=0, 1, . . . , P−1) of each subband $SB_p$ (p=0, 1, . . . , P−1), which is shown in above-described equation 16. The filter function shown in equation 15 is also used in filtering section 353. Here, in the filter processing and the filter function, T in equation 15 and equation 16 is replaced with $T_p'$.

Here, filtering section 353 performs filtering processing on the first subband using pitch coefficient $T_1'$ as is. In addition, filtering section 353 performs filtering processing on subband $SB_p$ (p=1, 2, . . . , P−1) subsequent to the second subband by setting new pitch coefficient $T_p''$ of subband $SB_p$ taking into account pitch coefficient $T_{p-1}'$ of subband $SB_{p-1}$ and using this pitch coefficient $T_p''$. To be more specific, when performing filtering processing on subbands $SB_p$ (p=1, 2, . . . , P−1) subsequent to the second subband, filtering section 353 calculates pitch coefficient $T_p''$ used for filtering by applying pitch coefficient $T_{p-1}'$ and bandwidth $BW_{p-1}$ of subband $SB_{p-1}$ to the pitch coefficient obtained by demultiplexing section 351, according to following equation 18. Filtering processing in this case is performed according to an equation replacing T in equation 16 with $T_p''$.

[18]

$$T_p''=T_{p-1}'+BW_{p-1}-\text{SEARCH}/2+T_p' \quad \text{(Equation 18)}$$

In equation 18, pitch coefficient $T_p''$ is calculated for subbands $SB_p$(p=1, 2, . . . , P−1) by adding bandwidth $BW_{p-1}$ of subband $SB_{p-1}$ to pitch coefficient $T_{p-1}'$ of subband $SB_{p-1}$ and adding $T_p'$ to the index resulting from subtracting a value half the search range SEARCH.

Gain decoding section 354 decodes the index of amount of variation after decoding $VQ_j$ inputted from demultiplexing section 351 and calculates amount of variation $VQ_j$, which is a quantized value of amount of variation $V_j$.

Spectrum adjusting section 355 calculates estimated spectrum S2'(*k*) of an input spectrum by using estimated spectrum $S2_p'(k)$(p=0, 1, . . . , P−1) of subbands $SB_p$(p=0,1, . . . , P−1) inputted from filtering section 353, which are continued in the frequency domain. In addition, spectrum adjusting section 355 multiplies estimated spectrum S2'(*k*) by amount of variation $VQ_j$ for each subband inputted from gain decoding section 354 according to following equation 19. By this means, spectrum adjusting section 355 adjusts the spectral shape of estimated spectrum S2'(*k*) in the frequency band of FL≦k<FH, generates decoded spectrum S3(*k*) and outputs it to orthogonal transform processing section 356.

[19]

$$S3(k)=S2'(k)\cdot VQ_j\ (BL_j\leqq k\leqq BH_j,\ \text{for all}\ j) \quad \text{(Equation 19)}$$

Here, the lower frequency band of 0≦k<FL of decoded spectrum S3(*k*) is formed by first layer decoded spectrum S1(*k*) and the high frequency band of FL≦k<FH of decoded spectrum S3(*k*) is formed by estimated spectrum S2'(*k*) after adjusting the spectral shape.

Orthogonal transform processing section 356 orthogonally transforms decoded spectrum S3(*k*) inputted from spectrum adjusting section 355 into a time domain signal and outputs an obtained second layer decoded signal as an output signal. Here, discontinuity between frames is prevented by performing processing including appropriate windowing, overlapped addition and so forth according to need.

Now, specific processing in orthogonal transform processing section 356 will be described.

Orthogonal transform processing section 356 has inside buffer buf'(k) and initializes buffer buf'(k) as shown in following equation 20.

[20]

$$\text{buf}'(k)=0\ (k=0, \ldots, N-1) \quad \text{(Equation 20)}$$

In addition, orthogonal transform processing section 356 calculates second layer decoded signal $y_n''$ using second layer decoded spectrum S3(*k*) inputted from spectrum adjusting section 355 according to following equation 21.

[21]

$$y_n''=\frac{2}{N}\sum_{n=0}^{2N-1} Z4(k)\cos\left[\frac{(2n+1+N)(2k+1)\pi}{4N}\right] \quad \text{(Equation 21)}$$

$$(n=0, \ldots, N-1)$$

In equation 21, Z4(*k*) is a vector obtained by combining decoded vector S3(*k*) and buffer buf'(k) as shown in following equation 22.

[22]

$$Z4(k)=\begin{cases} buf'(k) & (k=0, \ldots N-1) \\ S3(k) & (k=N, \ldots 2N-1) \end{cases} \quad \text{(Equation 22)}$$

Next, orthogonal transform processing section 356 updates buffer buf'(k) according to following equation 23.

[23]

$$\text{buf}'(k)=S3(k)\ (k=0, \ldots N-1) \quad \text{(Equation 23)}$$

Next, orthogonal transform processing section 356 outputs decoded signal $y_n''$ as an output signal.

As described above, according to the present embodiment, in coding/decoding to estimate the spectrum of the higher frequency band by performing band extension using the spectrum of the lower frequency band, the higher frequency band is divided into a plurality of subbands and coding is performed per subband by dividing and using the coding result of a neighboring subband. That is, since search is efficiently performed using correlation between subbands in the higher frequency band (adaptive degree of similarity search method: ASS), it is possible to efficiently encode and decode the higher frequency band spectrum, and it is possible to prevent noise contained in a decoded signal, and improve the quality of a decoded signal. In addition, according to the present invention, by performing the above-described efficient search in the higher frequency band spectrum, it is possible to reduce the amount of computation to search for the similar part required to provide a decoded signal with the same quality as in a method of coding/decoding the higher frequency band spectrum without using correlation between subbands.

Here, with the present embodiment, a case has been described as an example where number J of subbands obtained by dividing the higher frequency band of input spectrum S2(*k*) in gain coding section 265 differs from number P of subbands obtained by dividing the high frequency band of input spectrum S2(*k*) in search for section 263. However, the present invention is not limited to this, the number of subbands obtained by dividing the high frequency band of input spectrum S2(*k*) in gain coding section 265 may be P. In addition, in this case, as described clearly in Patent Document 2, gain coding section 265 may use the ideal gain used at the time searching section 263 searched for optimal pitch coefficient $T_p'$(p=0, 1, . . . , P−1) instead of the square root of the spectral power for each subband as shown in equation 14. Here, the ideal gain used at the time the optimal pitch coefficient $T_p'$(p=0, 1, . . . , P−1) was searched is calculated by following equation 24. Here, M' of equation 24 is the same as the value of M' of equation 17 used at the time optimal pitch coefficient $T_p'$ was calculated.

[24]

$$\beta_p = \frac{\sum_{k=0}^{M'} S2(BS_p + k) \cdot S2'(BS_p + k)}{\sum_{k=0}^{M'} S2'(BS_p + k) \cdot S2'(BS_p + k)} \quad \text{(Equation 24)}$$

$$\begin{pmatrix} p = 0, \ldots, P-1 \\ 0 < M' \leq BW_1 \end{pmatrix}$$

In addition, with the present embodiment, although a case has been described as an example where pitch coefficient setting section 264 sets the range to search for pitch coefficient T as equation 9, the present invention is not limited to this and the range to search for pitch coefficient T may be set according to following equation 25.

[25]

$$T_{p-1}'-\text{SEARCH}/2 \leqq T \leqq T_{p-1}'+\text{SEARCH}/2 \quad \text{(Equation 25)}$$

In equation 25, pitch coefficient T is set to a value close to optimal pitch coefficient $T_{p-1}'$ for subband $SB_{p-1}$. This reason is that the band part of the first layer decoded spectrum most similar to subband $SB_{p-1}$ is highly likely to be also similar to subband $SB_p$. In particular, when the correlation between subband $SB_{p-1}$ and subband $SB_p$ is significantly high, it is possible to more efficiently perform search by the above-described method of setting pitch coefficients. Here, when pitch coefficient setting section 264 sets the range to search for pitch coefficient T as equation 25, filtering section 353 calculates pitch coefficient $T_p''$ used for filtering according to equation 26, instead of equation 18.

[26]

$$T_p''=T_{p-1}'-\text{SEARCH}/2+T_p' \quad \text{(Equation 26)}$$

Moreover, with each of the above-described embodiments, a case has been described as an example where the range to search for the pitch coefficient for each subband $SB_p$(p=1, 2, . . . , P−1) subsequent to the second subband is set based on the results of search with respect to neighboring subbands. However, the present invention is not limited to this, and in part of subbands, the range to search for the pitch coefficients may be fixed to the range from Tmin to Tmax in the same way as of the first subband. For example, when the ranges to search for pitch coefficients are set for consecutive subbands equal to or greater than the predetermined fixed number, based on the result of search for each neighboring subband, the ranges to search for the pitch coefficients of subsequent subbands are fixed to the range from Tmin to Tmax in the same way as of the first subband. By this means, it is possible to prevent the result of search for the first subband $SB_0$ from influencing the results of search for all subbands from second subbands $SB_1$ to P-th subbands $SB_{P-1}$. That is, it is possible to prevent an object to search for similar parts in a certain subband from excessively being biased toward the higher frequency band. By this means, it is possible to prevent occurrence of noise or sound quality deterioration, which may be caused by limiting the range to search for a similar part to a subband, to the high frequency band of the first layer decoded spectrum although the similar part to the subband normally exists in the low frequency band of the first layer decoded spectrum.

(Embodiment 2)

With Embodiment 2 of the present invention, a case will be described where the first layer coding section does not use the CELP coding method shown in Embodiment 1 but uses transform coding such as MDCT and so forth.

The communication system (not shown) according to Embodiment 2 is basically the same as the communication system shown in FIG. 2, but the configurations and operations of the coding apparatus and decoding apparatus differ only in part from those of coding apparatus 101 and decoding apparatus 103 in the communication system shown in FIG. 2. Now, the coding apparatus and the decoding apparatus in the communication system according to the present embodiment will be assigned reference numerals "111" and "113," respectively, and explained.

Figure 9:
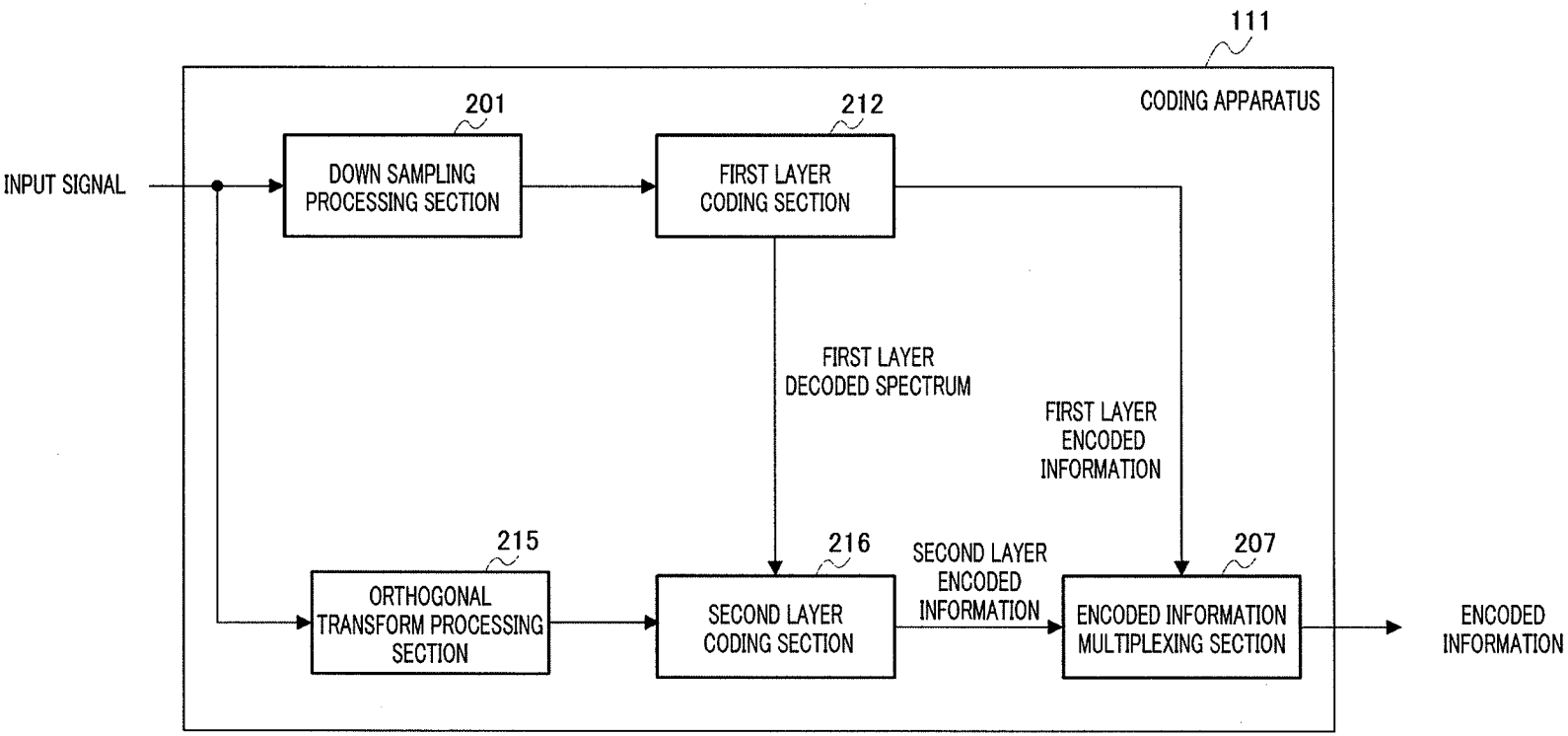
FIG. 9 is a block diagram showing primary parts in a coding apparatus according to Embodiment 2 of the present invention.

FIG. 9 is a block diagram showing primary parts in coding apparatus 111 according to the present embodiment. Here, coding apparatus 111 according to the present embodiment is composed mainly of downsampling processing section 201, first layer coding section 212, orthogonal transform processing section 215, second layer coding section 216 and encoded information multiplexing section 207. Here, downsampling processing section 201 and encoded information multiplexing section 205 perform the same processing as in Embodiment 1, so that descriptions will be omitted.

First layer coding section 212 performs coding on the input signal after downsampling inputted from downsampling processing section 201by the transform coding method. To be more specific, first layer coding section 212 transforms the inputted time domain input signal after downsampling into a frequency domain component using the technique such as MDCT and quantizes the resulting frequency component. First layer coding section 212 directly outputs the quantized frequency component to second layer coding section 216 as a first layer decoded spectrum. The MDCT processing in first layer coding section 212 is the same as the MDCT processing shown in Embodiment 1, so that detailed descriptions will be omitted.

Orthogonal transform processing section 215 performs orthogonal transform such as MDCT on the input signal and outputs a resulting frequency component to second layer coding section 216 as the higher frequency band spectrum. The MDCT processing in orthogonal transform processing section 215 is the same as the MDCT processing shown in Embodiment 1, so that detailed descriptions will be omitted.

The processing in second layer coding section 216 is the same as in second layer coding section 206 shown in FIG. 3 except that the first layer decoded spectrum is inputted from first layer coding section 212, so that detailed descriptions will be omitted.

Figure 10:
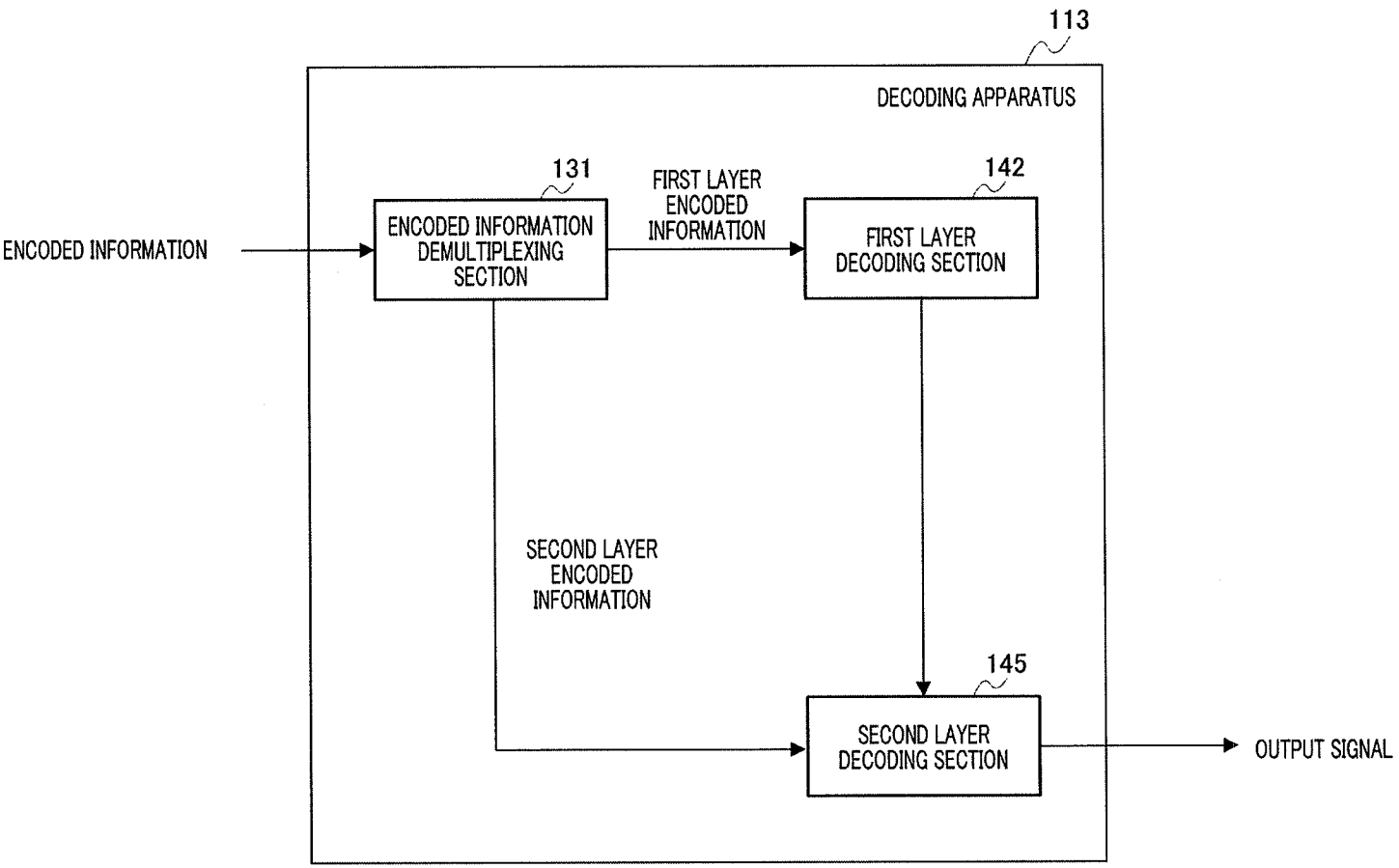
FIG. 10 is a block diagram showing primary parts in a decoding apparatus according to Embodiment 2 of the present invention.

FIG. 10 is a block diagram showing primary parts in decoding apparatus 113 according to the present embodiment. Here, decoding apparatus 113 according to the present embodiment is composed mainly of encoded information demultiplexing section 131, first layer decoding section 142 and second layer decoding section 145. In addition, encoded information demultiplexing section 131 performs the same processing as in Embodiment 1, so that detailed descriptions will be omitted.

First layer decoding section 142 decodes first layer encoded information inputted from encoded information demultiplexing section 131 and outputs an obtained first layer decoded spectrum to second layer decoding section 145. A general dequantization method corresponding to the coding method used in first layer coding section 212 shown in FIG. 9 is adopted for the decoding processing in first layer decoding section 142, and detailed descriptions will be omitted.

The processing in second layer decoding section 145 is the same as in second layer decoding section 135 shown in FIG. 7 except that the first layer decoded spectrum is inputted from first layer deciding section 142, so that detailed descriptions will be omitted.

As described above, according to the present embodiment, in coding/decoding to estimate the spectrum of the higher frequency band by performing band extension using the spectrum of the lower frequency band, the higher frequency band is divided into a plurality of subbands and coding is performed per subband by dividing and using the coding result of a neighboring subband. That is, since search is efficiently performed using correlation between high frequency subbands, it is possible to more efficiently encode/decode a high frequency band spectrum, and therefore, it is possible to prevent noise contained in a decoded signal and improve the quality of a decoded signal.

In addition, according to the present embodiment, the present invention is applicable to a case in which, for example, a transform coding/decoding method is adopted for encoding the first layer instead of the CELP coding/decoding. In this case, it is not necessary to calculate the first layer decoded spectrum by performing separately orthogonal transform on the first layer decoded signal after first layer coding, so that it is possible to reduce the amount of computation for the first layer decoded spectrum.

Here, with the present embodiment, although a case has been described as an example where an input signal is downsampled by downsampling processing section 201 and then inputted to first layer coding section 212, the present invention is not limited to this. Downsampling processing section 201 may be omitted and the input spectrum outputted from orthogonal transform processing section 215 may be inputted to first layer coding section 212. In this case, orthogonal transform processing in first layer coding section 212 is allowed to be omitted, and therefore, it is possible to reduce the amount of computation for orthogonal transform processing.

(Embodiment 3)

With Embodiment 3 of the present invention, a configuration will be described that analyzes the degree of correlation between high frequency subbands and switches between performing and not performing search using the optimal pitch period of a neighboring subband based on the analysis result.

The communication system (not shown) according to Embodiment 3 of the present invention is basically the same as the communication system shown in FIG. 2, but the configurations and operations of the coding apparatus and decoding apparatus differ only in part from those of coding apparatus 101 and decoding apparatus 103 in the communication system shown in FIG. 2. Now, the coding apparatus and the decoding apparatus in the communication system according to the present embodiment will be assigned reference numerals "121" and "123," respectively, and explained.

Figure 11:
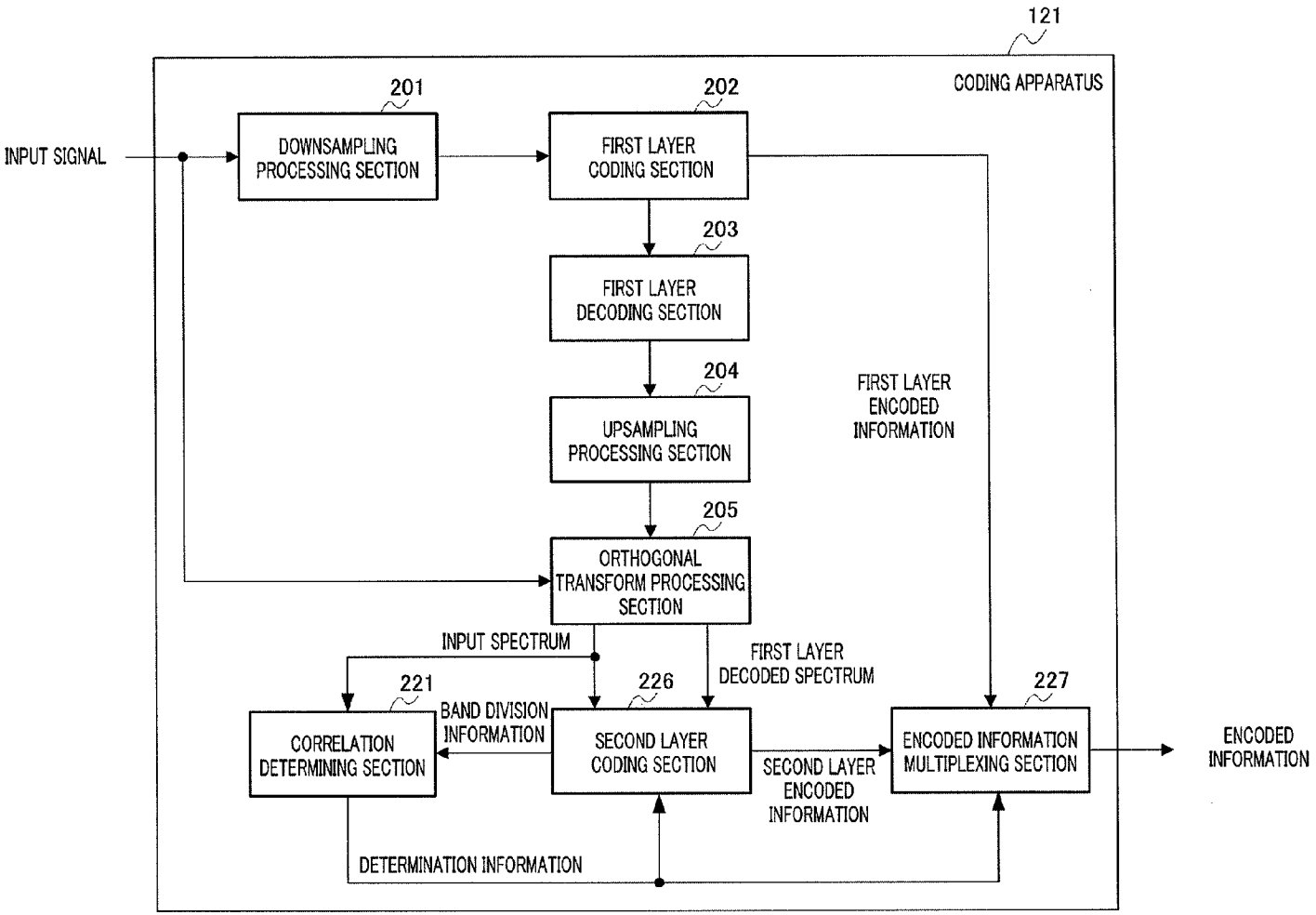
FIG. 11 is a block diagram showing primary parts in a coding apparatus according to Embodiment 3 of the present invention.

FIG. 11 is a block diagram showing primary parts in coding apparatus 121 according to the present embodiment. Coding apparatus 121 according to the present embodiment is composed mainly of downsampling processing section 201, first layer coding section 202, first layer decoding section 203, upsampling processing section 204, orthogonal transform processing section 205, correlation determining section 221, second layer coding section 226 and encoded information multiplexing section 227. Here, parts except for correlation determining section 221, second layer coding section 226 and encoded information multiplexing section 227 are the same as in Embodiment 1, so that descriptions will be omitted.

Correlation determining section 221 calculates correlation between each subband of the higher frequency band ($FL \leqq k < FH$) of the input spectrum inputted from orthogonal transform processing section 205, based on band division information inputted from second layer coding section 226, and sets the value of determination information to "0" or "1" based on the calculated correlation value. To be more specific, correlation determining section 221 calculates the spectral flatness measure (SFT) for each of P subbands and calculates the difference between the SFM values of neighboring subbands ($SFM_p - SFM_{p+1}$)(p=0, 1 , . . . , P−2). Correlation determining section 221 compares the absolute value for each of ($SFM_p - SFM_p+_1$)(p=0, 1 . . . , P−2) with predetermined threshold value $TH_{SFM}$, and, when the number of ($SFM_p - SFM_{p+1}$) having lower absolute values than $TH_{SFM}$ is equal to or greater than a predetermined number, determines that correlation between neighboring subbands is high over the entire higher frequency band of the input spectrum and makes the value of determination information "1." Otherwise, correlation determining section 221 makes values of determination information "0." Correlation determining section 221 outputs the set determination information to second layer coding section 226 and encoded information multiplexing section 227.

Second layer coding section 226 generates second layer encoded information using input spectrum S2(*k*) and first layer decoded spectrum S1(*k*) inputted from orthogonal transform processing section 205, and determination information inputted from correlation determining section 221 and outputs the generated second layer encoded information to encoded information multiplexing section 227. In addition, second layer coding section 226 outputs band division information calculated inside, to correlation determining section 221. The band division information in second layer coding section 226 will be described in detail later.

Figure 12:
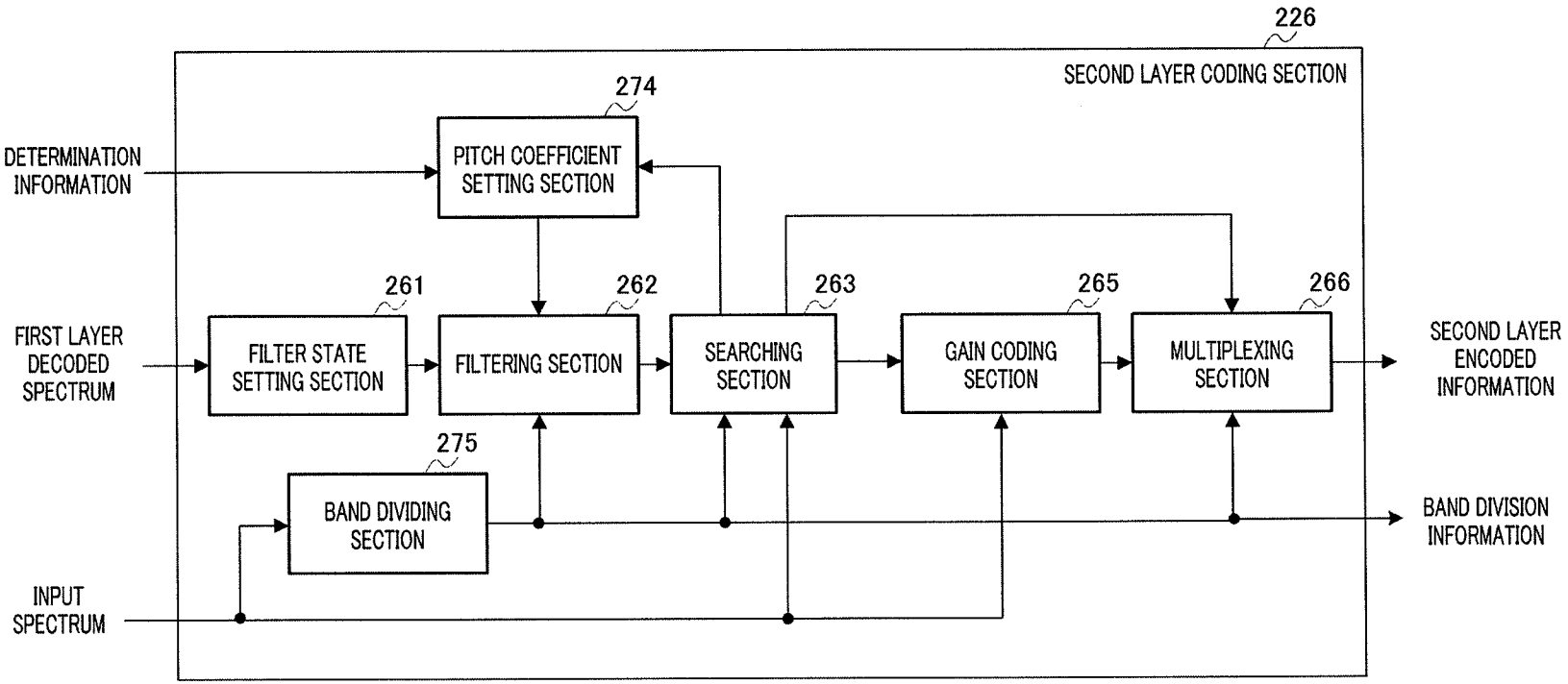
FIG. 12 is a block diagram showing primary parts in the second layer coding section shown in FIG. 11.

FIG. 12 is a block diagram showing primary parts in second layer coding section 226 shown in FIG. 11.

Parts in second coding section 226 are the same as in Embodiment 1 except for pitch coefficient setting section 274 and band dividing section 275, so that descriptions will be omitted.

When determination information inputted from correlation determining section 221 is "0," pitch coefficient setting section 274 sequentially outputs pitch coefficient T to filtering section 262 by changing pitch coefficient T little by little in a predetermined search range from Tmin to Tmax under the control of searching section 263. That is, when determination information inputted from correlation determining section 221 is "0," pitch coefficient setting section 274 sets pitch coefficient T not taking into account the results of search with respect to neighboring subbands.

In addition, when detection information inputted from correlation determining section 221 is "1," pitch coefficient setting section 274 performs the same processing as in pitch coefficient setting section 264 according to Embodiment 1. That is, when performing closed-loop search processing for first subband $SB_0$ with filtering section 262 and searching section 263 under the control of searching section 263, pitch coefficient setting section 274 sequentially outputs pitch coefficient T to filtering section 262 by changing pitch coefficient T little by little in a predetermined search range from Tmin to Tmax. Meanwhile, when performing closed-loop search processing for subband $SB_p$(p=1, 2, . . . , P−1) subsequent to the second subband with filtering section 262 and searching section 263 under the control of searching section 263, pitch setting section 274 sequentially outputs pitch coefficient T to filtering section 262 using optimal pitch coefficient $T_{p-1}'$ calculated in the closed-loop search processing for subband $SB_{p-1}$ by changing pitch coefficient T little by little according to above-described equation 9.

In short, pitch coefficient setting section 274 adaptively switches between setting and not setting the pitch coefficient using the results of search for neighboring subbands in accordance with the value of inputted determination information. Therefore, it is possible to use the results of search for neighboring subbands only when correlation between subbands in a frame is equal to or higher than a predetermined level, and, when correlation between subbands is lower than the predetermined level, it is possible to prevent decrease in the accuracy of coding using the results of search for neighboring subbands.

Band dividing section 275 divides the higher frequency band ($FL \leqq k < FH$) of input spectrum $S2(k)$ inputted from orthogonal transform processing section 205 into P subbands $SB_p$(p=0, 1, . . . , P−1). Then, band division section 275 outputs bandwidth $BW_p$ (p=0, 1, . . . , P−1) and first index $BS_p$(p=0, 1, . . . , P−1)($FL \leqq BS_p < FH$) of each subband to filtering section 262, searching section 263, multiplexing section 266 and correlation determining section 221, as band division information.

Encoded information multiplexing section 227 multiplexes first layer encoded information inputted from first layer coding section 202, determination information inputted from correlation determining section 221 and second layer encoded information inputted from second layer coding section 226, and, if necessary, adds a transmission error code to the multiplexed information source code and outputs it to transmission channel 102 as encoded information.

Figure 13:
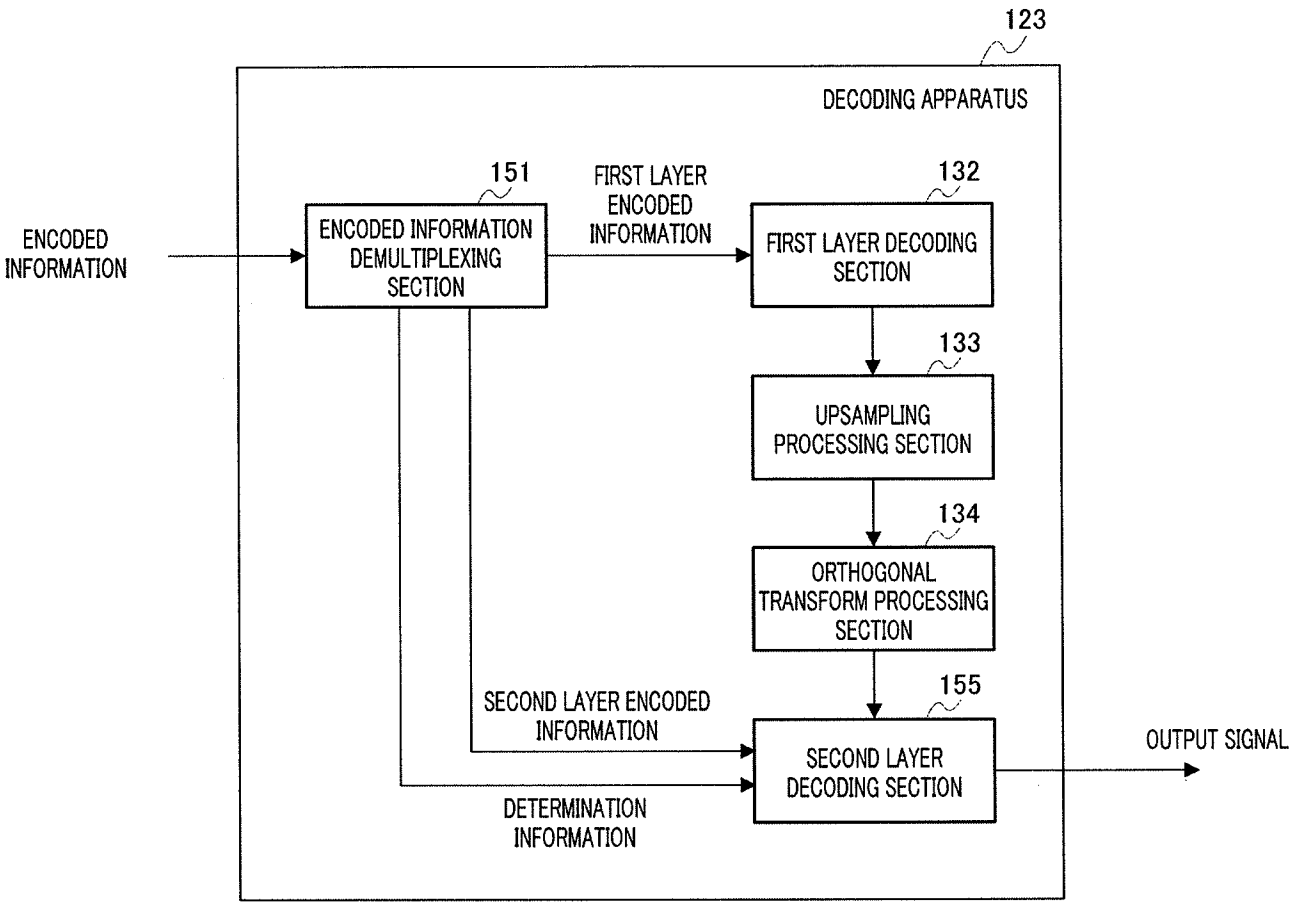
FIG. 13 is a block diagram showing primary parts in the decoding apparatus according to Embodiment 3 of the present invention.

FIG. 13 is a block diagram showing primary parts in decoding apparatus 123 according to the present embodiment. Decoding apparatus 123 according to the present embodiment is composed mainly of encoded information demultiplexing section 151, first layer decoding section 132, upsampling processing section 133, orthogonal transform processing section 134 and second layer decoding section 155. Here, parts except for encoded information demultiplexing section 151 and second layer decoding section 155 are the same as in Embodiment 1, so that descriptions will be omitted.

In FIG. 13, encoded information demultiplexing section 151 demultiplexes first layer encoded information, second layer encoded information and determination information from inputted encoded information, outputs the first layer encoded information to first layer decoding section 132 and outputs the second layer encoded information and the determination information to second layer decoding section 155.

Second layer decoding section 155 generates a second layer decoded signal containing a high frequency component using first layer decoded spectrum $S1(k)$ inputted from orthogonal transform processing section 134, and the second layer encoded information and the determination information inputted from encoded information demultiplexing section 131, and outputs it as an output signal.

Figure 14:
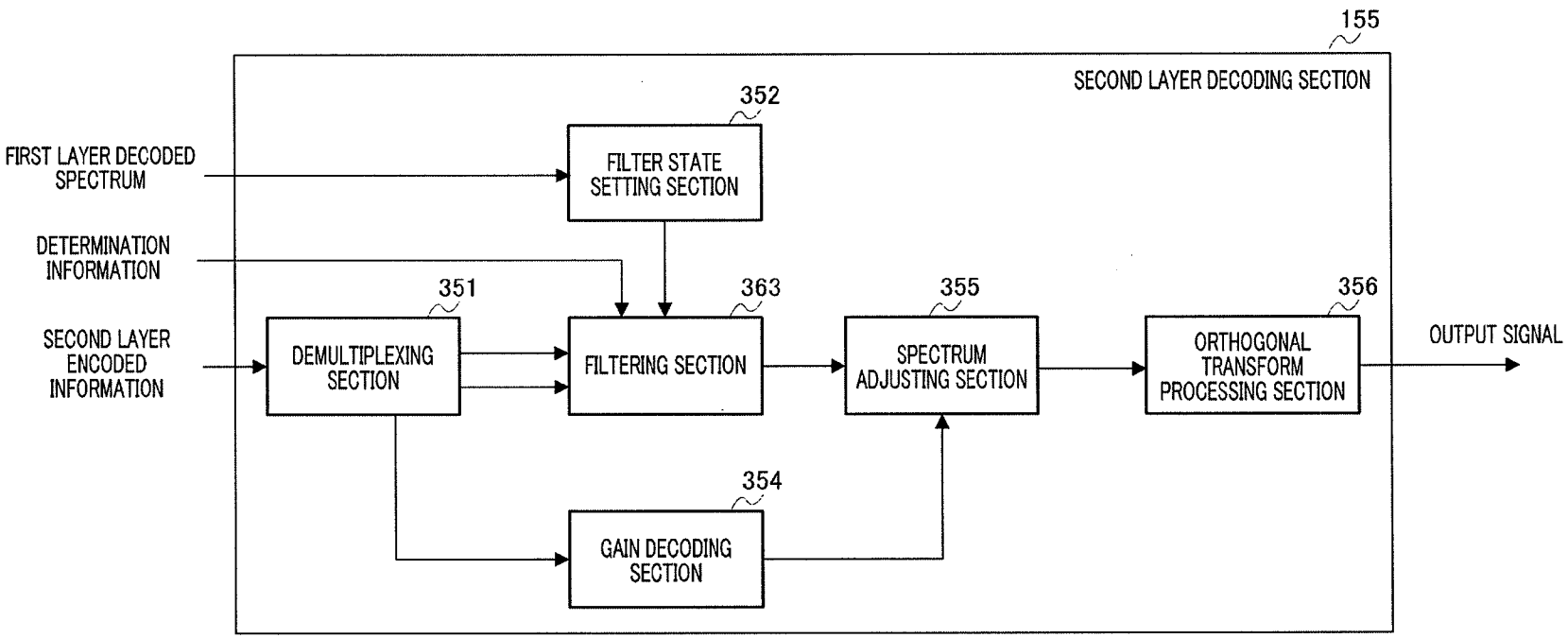
FIG. 14 is a block diagram showing primary parts in a second layer coding section shown in FIG. 13.

FIG. 14 is a block diagram showing primary parts in second layer decoding section 155 shown in FIG. 13.

In FIG. 14, parts except for filtering section 363 are the same as in Embodiment 1, so that descriptions will be omitted.

Filtering section 363 has a multi-tap (the number of taps is more than one) pitch filter. Filtering section 363 filters first layer decoded spectrum $S1(k)$ based on band division information inputted from demultiplexing section 351, a filter state set by filter state setting section 352, pitch coefficient $T_p'$ inputted from demultiplexing section 351 and a filter coefficient stored inside in advance, according to determination information inputted from encoded information demultiplexing section 151, and calculates estimation value $S2_p'(k)$ ($BS_p \leqq k < BS_p + BW_p$)(p=0, 1, . . . , P−1) for each subband $SB_p$(p=0, 1, . . . , P−1).

Here, processing in filtering section 363 according to determination information will be described in detail. When inputted determination information is "0," filtering section 363 filters each of P subbands from subband $SB_0$ to subband $SB_{P-1}$ using pitch coefficient $T_p'$ inputted from demultiplexing section 351 not taking into account the pitch coefficients of neighboring subbands. In the filter processing and the filter function, T in equation 15 and equation 16 is replaced with $T_p'$.

In addition, when inputted determination information is "1," filtering section 363 performs the same processing as in filtering section 353 shown in FIG. 8. That is, filtering section 363 filters the first subband using pitch coefficient $T_1'$ as is. In addition, filtering section 363 newly sets pitch coefficient $T_p''$ for subband $SB_p$ (p=1, 2, . . . , P−1) subsequent to the second subband taking into account pitch coefficient $T_{p-1}'$ for subband $SB_{p-1}$ and filters subband $SB_p$ using this pitch coefficient $T_p''$. To be more specific, performing filtering on subbands $SB_p$(p=1, 2, . . . , P−1) subsequent to the second subband, filtering section 363 calculates pitch coefficient $T_p''$ used for filtering by applying pitch coefficient $T_{p-1}'$ and bandwidth $BW_{p-1}$ of subband $SB_{p-1}$ to the pitch coefficient obtained from demultiplexing section 351, according to above-described equation 18. In the filter processing and the filter function, T in equation 15 and equation 16 is replaced with $T_p'$.

As described above, according to the present embodiment, in coding/decoding to estimate the spectrum of the higher frequency band by performing band extension using the spectrum of the lower frequency band, the higher frequency band is divided into a plurality of subbands and adaptively switches between performing and not performing coding per subband using the coding results of neighboring subbands, based on the analysis result of the degree of correlation between subbands per frame. That is, only when correlation between subbands in a frame is equal to or higher than a predetermined level, it is possible to efficiently encode/decode a higher frequency band spectrum by performing efficient search using correlation between subbands and prevent occurrence of noise contained in a decoded signal. In addition, when correlation between subbands in a frame is lower than a predetermined level, the results of search for neighboring subbands are not used, so that it is possible to prevent decrease in the accuracy of coding due to use of the results of search for neighboring subbands with a low degree of correlation, and therefore it is possible to improve the quality of a decoded signal.

Here, with the present embodiment, although a case has been described as an example where the value of determination information is set by analyzing the SFM value per subband and determining correlation per frame taking into account the SFM values of all subbands contained in one frame, the present embodiment is not limited to this, and the value of determination information may be set by separately determining correlation per subband. In addition, the value of determination information may be set by calculating the energy of each subband instead of the SFM value, and determining correlation in accordance with energy differences or ratios between subbands. Moreover, the value of determination information may be set by calculating correlation in the frequency component (MDCT coefficient and so forth) between subbands by correlation computation and comparing the correlation value with a predetermined threshold.

Moreover, with the present embodiment, although a case has been described as an example where, when the value of determination information is "1," pitch coefficient setting section 274 sets the range to search for pitch coefficient T as in above-described equation 9, the present invention is not limited to this, and the range to search for pitch coefficient T may be set as in above-described equation 25.

(Embodiment 4)

With Embodiment 4 of the present invention, a configuration will be described where the sampling frequency of an input signal is 32 kHz and where the G.729.1 method standardized by ITU-T is applied as a coding method for the first layer coding section.

The communication system (not shown) according to Embodiment 4 is basically the same as the communication system shown in FIG. 2, but the configurations and operations of the coding apparatus and decoding apparatus differ only in part from those of coding apparatus 101 and decoding apparatus 103 in the communication system shown in FIG. 2. Now, the coding apparatus and the decoding apparatus in the communication system according to the present embodiment will be assigned reference numerals "161" and "163," respectively, and explained.

Figure 15:
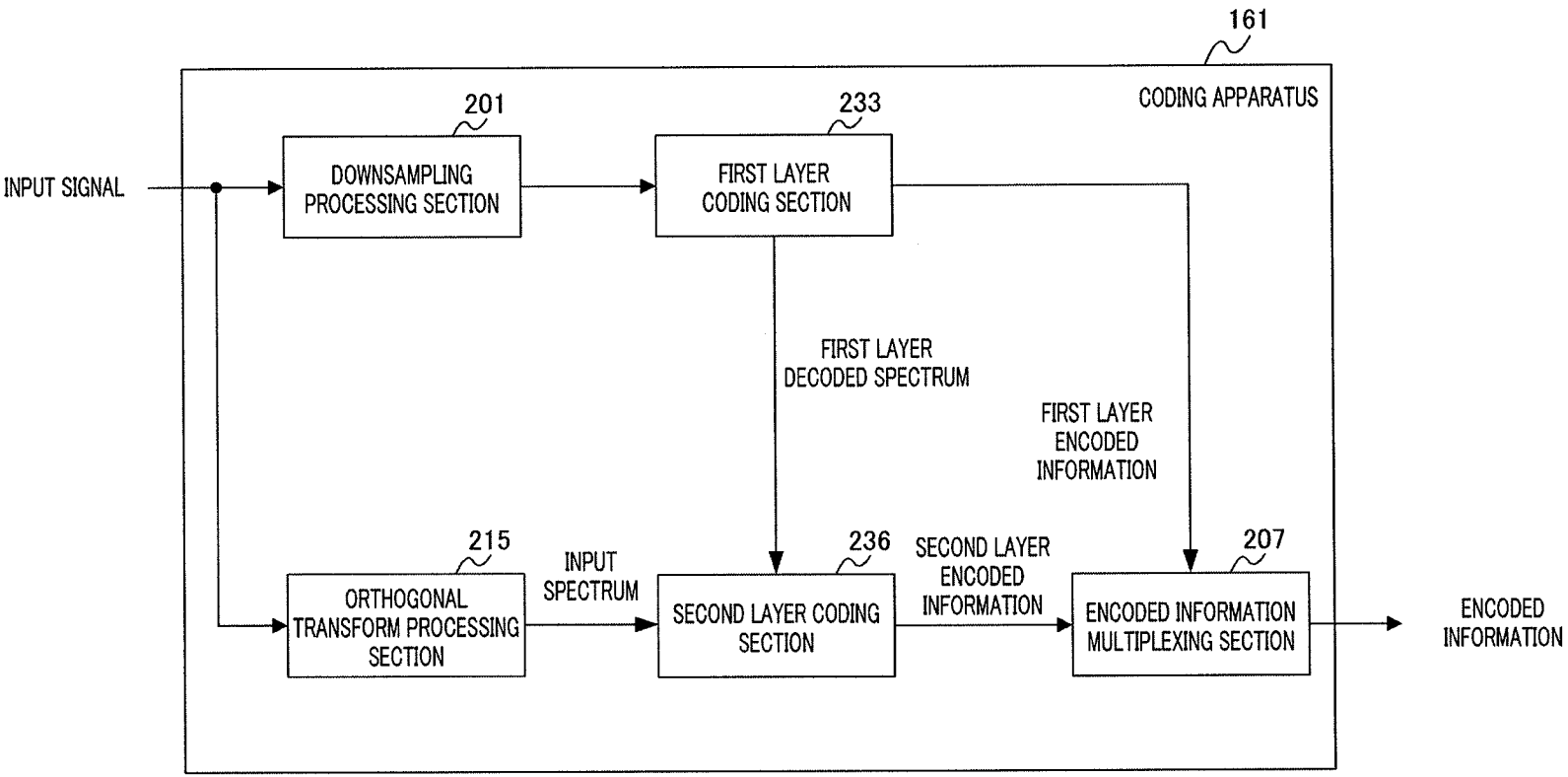
FIG. 15 is a block diagram showing primary parts of a coding apparatus according to Embodiment 4 of the present invention.

FIG. 15 is a block diagram showing primary parts in coding apparatus 161 according to the present embodiment. Coding apparatus 161 according to the present embodiment is composed mainly of downsampling processing section 201, first layer coding section 233, orthogonal transform processing section 215, second layer coding section 236 and encoded information multiplexing section 207. Parts except for first layer coding section 233 and second layer coding section 236 are the same as in Embodiment 1, so that descriptions will be omitted.

First layer coding section 233 generates first layer encoded information by encoding an input signal after downsampling inputted from downsampling processing section 201 using the G.729.1 speech coding method. Then, first layer coding section 233 outputs the generated first layer coding information to encoded information multiplexing section 207. In addition, first layer coding section 233 outputs information obtained in the process of generating first layer encoded information to second layer coding section 236 as a first layer decoded spectrum. Here, first layer coding section 233 will be described in detail later.

Second layer coding section 236 generates second layer encoded information using an input spectrum inputted from orthogonal transform processing section 215 and a first layer decoded spectrum inputted from first layer coding section 233 and outputs the generated second layer encoded information to encoded information multiplexing section 207. Here, second layer coding section 236 will be described in detail later.

Figure 16:
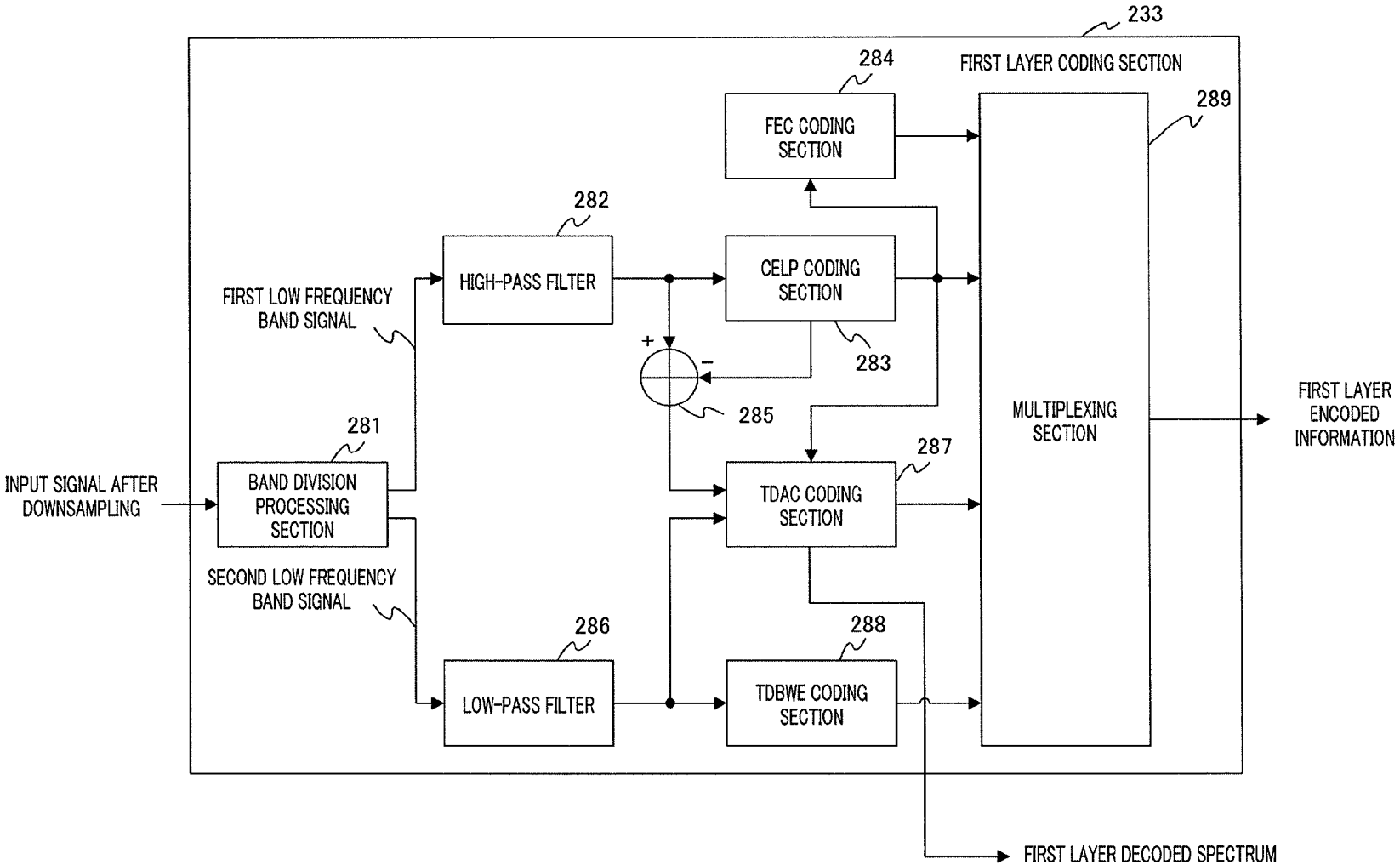
FIG. 16 is a block diagram showing primary parts in the first layer coding section shown in FIG. 15.

FIG. 16 is a block diagram showing primary parts in first layer coding section 233 shown in FIG. 15. Here, a case in which the G.729.1 coding method is applied to first layer coding section 233 will be described as an example.

First layer coding section 233 shown in FIG. 16 includes band division processing section 281, high-pass filter 282 CELP (Code Excited Linear Prediction) coding section 283, FEC (Forward Error Correction) coding section 284, adding section 285, low-pass filter 286, TDAC (Time-Domain Aliasing Cancellation) coding section 287, TDBWE (Time-Domain Bandwidth Extension) coding section 288 and multiplying section 289, and these parts perform the following operations, respectively.

Band division processing section 281 performs band division processing with a quadrature mirror filter (QMF) and so forth on an input signal after downsampling sampled at a frequency of 16 kHz, which is inputted from downsampling section 201 to generate a first low frequency band signal of the band from 0 to 4 kHz and a second low frequency band signal of the band from 4 to 8 kHz. Band division processing section 281 outputs the generated first low frequency band signal to high-pass filter 282 and outputs the second low frequency band signal to low-pass filter 286.

High-pass filter 282 removes the frequency component equal to or lower than 0.05 kHz of the first low frequency band signal inputted from band division processing section 281 to obtain a signal mainly composed of high frequency components higher than 0.05 kHz and outputs it to CELP coding section 283 and adding section 285 as the first low frequency band signal after filtering.

CELP coding section 283 performs CELP coding on the first low frequency band signal after filtering onputted from high-pass filter 282 and outputs the resulting CELP parameters to FEC coding section 284, TDAC coding section 287 and multiplexing section 289. Here, CELP coding section 283 may output part of the CELP parameters or information obtained in the process of generating the CELP parameters, to FEC coding section 284 and TDAC coding section 287. In addition, CELP coding section 283 performs CELP decoding using the generated CELP parameters and outputs the resulting CELP decoded signal to adding section 285.

FEC coding section 284 calculates FEC parameters used for lost frame compensation processing in decoding apparatus 163 using the CELP parameters inputted from CELP coding section 283 and outputs the calculated FEC parameters to multiplexing section 289.

Adding section 285 outputs, to TDAC coding section 287, a differential signal resulting from subtracting the CELP decoded signal inputted from CELP coding section 283 from the first low frequency band signal after filtering onputted from high-pass filter 282.

Low-pass filter 286 removes frequency components of the second low frequency band signal higher than 7 kHz inputted from band division processing section 281 to obtain a signal composed mainly of frequency components equal to or lower than 7 kHz and outputs the signal to TDAC coding section 287 and TDBWE coding section 288 as a second low frequency band signal after filtering.

TDAC coding section 287 performs orthogonal transform such as MDCT on the differential signal inputted from adding section 285 and the second low frequency band signal after filtering onputted from low-pass filter 286 and quantizes the resulting frequency domain signal (MDCT coefficient). Then, TDAC coding section 287 outputs TDAC parameters resulting from quantization to multiplexing section 289. In addition, TDAC coding section 287 performs decoding using the TDAC parameters and outputs an obtained decoded spectrum to second layer coding section 236 (FIG. 15) as the first layer decoded spectrum.

TDBWE coding section 288 performs band extension coding in the time domain on the second low frequency band signal after filtering onputted from low-pass filter 286 and outputs obtained TDBWE parameters to multiplexing section 289.

Multiplexing section 289 multiplexes the FEC parameters, the CELP parameters, the TDAC parameters and the TDBWE parameters and outputs the result to encoded information multiplexing section 237 (FIG. 15) as first layer encoded information. Here, these parameters may be multiplexed in encoded information multiplexing section 237 without providing multiplexing section 289 in first layer coding section 233.

Coding in first layer coding section 233 according to the present embodiment shown in FIG. 16 differs from the G.729.1 coding in that TDAC coding section 287 outputs a decoded spectrum resulting from decoding TDAC parameters to second layer coding section 236 as the first layer decoded spectrum.

Figure 17:
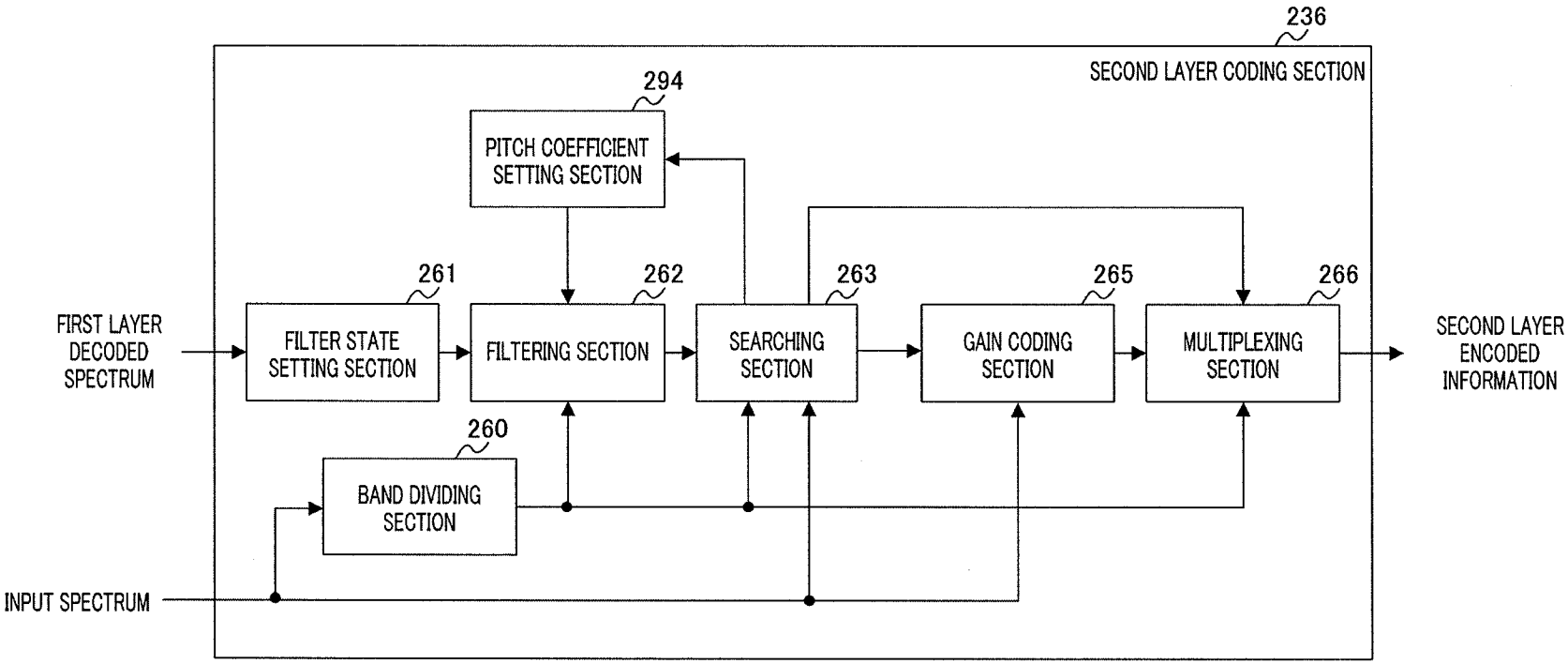
FIG. 17 is a block diagram showing primary parts in the second layer coding section shown in FIG. 15.

FIG. 17 is a block diagram showing primary parts in second layer coding section 236 shown in FIG. 15.

Parts except for pitch coefficient setting section 294 in second layer coding section 236 are the same as in Embodiment 1, so that descriptions will be omitted.

In addition, a case will be described as an example where band dividing section 260 shown in FIG. 17 divides the higher frequency band ($FL \leqq k < FH$) of input spectrum S2($k$) to five subbands $SB_p$(p=0, 1, . . . , 4). That is, a case will be described here the number of subbands P in Embodiment 1 is five (P=5). Here, the present invention does not limit the number of subbands resulting from dividing the higher frequency band of input spectrum S2, and is equally applicable to a case in which the number of subbands P is not five ($P \neq 5$).

Pitch coefficient setting section 294 sets in advance pitch coefficient search ranges for part of a plurality of subbands and sets the pitch coefficient search ranges for the other subbands based on the search results of respective previous neighboring subbands.

For example, when performing closed-loop search processing for first subband $SB_0$, third subband $SB_2$ or fifth subband $SB_4$ (subband $SB_p$(p=0, 2, 4)) with filtering section 262 and searching section 263 under the control of searching section 263, pitch coefficient setting section 294 sequentially outputs pitch coefficient T to filtering section 262 by changing pitch coefficient T little by little in a predetermined search range. To be more specific, when performing closed-loop search processing for first subband $SB_0$, pitch coefficient setting section 294 sets pitch coefficient T for first subband $SB_0$ by changing pitch coefficient T little by little in the search range set in advance for the first subband from Tmin1 to Tmax1. In addition, when performing closed-loop search processing for third subband $SB_2$, pitch coefficient setting section 294 sets pitch coefficient T for third subband $SB_2$ by changing pitch coefficient T little by little in the search range set in advance for the third subband from Tmin3 to Tmax3. Likewise, when performing closed-loop search processing for fifth subband $SB_4$, pitch coefficient setting section 294 sets pitch coefficient T for fifth subband $SB_4$ by changing pitch coefficient T little by little in the search range set in advance for the fifth subband from Tmin5 to Tmax5.

Meanwhile, when performing closed-loop search processing for second subband $SB_1$ or fourth subband $SB_3$ (subband $SB_p$(p=1, 3)) with filtering section 262 and searching section 263, under the control of searching section 263, pitch coefficient setting section 294 sequentially outputs pitch coefficient T to filtering section 262 by changing pitch coefficient T little by little based on optimal pitch coefficient $T_{p-1}'$ calculated in the closed-loop search processing for previous neighboring subband $SB_{p-1}$. To be more specific, performing closed-loop search processing for second subband $SB_1$, pitch coefficient setting section 294 sets pitch coefficient T for second subband $SB_1$ by changing pitch coefficient T little by little in a search range calculated based on optimal pitch coefficient $T_0'$ of previous neighboring first subband $SB_0$, according to equation 9. In this case, P is one (p=1) in equation 9. Likewise, when performing closed-loop search processing for fourth subband $SB_3$, pitch coefficient setting section 294 sets pitch coefficient T for subband $SB_3$ by changing pitch coefficient T little by little in a search range calculated based on optimal pitch coefficient $T_2'$ of previous neighboring third subband $SB_2$, according to equation 9. In this case, P is three (P=3) in equation 9.

Here, when the value of the range of pitch coefficient T set according to equation 9 is higher than the upper limit of the band of the first layer decoded spectrum, the range of pitch coefficient T is corrected as shown in equation 10 in the same way as in Embodiment 1. Likewise, the value of the range of pitch coefficient T set according to equation 9 is lower than the lower limit of the first layer decoded spectral band, the range of pitch coefficient T is corrected as shown in equation 11 in the same way as in Embodiment 1. As described above, by correcting the range of pitch coefficient T, it is possible to efficiently perform coding without reducing the number of entries in search for an optimal pitch coefficient.

As described above, pitch coefficient setting section 294 changes little by little pitch coefficient T in a preset search range for each of the first subband, the third subband and the fifth subband. Here, pitch coefficient setting section 294 may set the range to search for pitch coefficient T for a plurality of subbands such that the range for a higher frequency subband is set in a higher band (higher frequency band) in the first decoded spectrum. That is, pitch coefficient 294 sets in advance the search range for each subband such that the search range for a higher frequency subband is set in a higher frequency band of the first decoded spectrum. For example, in a case in which there is a tendency that the harmonic structure of a spectrum is poor in a higher frequency band, part similar to a higher frequency subband is highly likely to reside in a higher frequency band in the first decoded spectrum. Therefore, pitch coefficient setting section 294 is set such that the search range for a higher frequency subband is biased toward a higher frequency band, so that searching section 263 can perform search in a suitable search range for each subband, and therefore it is possible to anticipate improvement of the efficiency of coding.

In addition, in opposition to the above-described setting method, pitch coefficient setting section 294 may set the range to search for pitch coefficient T for a plurality of subbands such that the search range for a higher frequency subband is set in a lower band (lower frequency band) in the first decoded spectrum. That is, pitch coefficient 294 sets in advance the search range for each subband such that the search range for a higher frequency subband is set in a lower frequency band in the first decoded spectrum. For example, when, in the first decoded spectrum, the spectrum between 0 and 4 kHz and the spectrum between 4 and 7 kHz are compared, and, in a case in which the harmonic structure of the spectrum between 0 and 4 kHz is poorer, the part similar to a higher frequency subband is highly likely to reside in a lower frequency band in the first decoded spectrum. Therefore, pitch coefficient setting section 294 is set such that the search range for a higher frequency subband is biased toward a lower frequency band, so that searching section 263 searches for a part similar to the higher frequency subband in a lower frequency band of the first decoded spectrum having a poorer harmonic structure than that in the higher frequency band, and therefore it is possible to improve the efficiency of coding. Here, with the present embodiment, a decoded spectrum obtained from TDAC coding section 287 in first layer coding section 233 is used as an exemplary first decoded spectrum. In this case, in the spectrum between 0 to 4 kHz of the first decoded spectrum, the CELP decoded signal calculated in CELP coding section 283 is subtracted from an input signal, so that its harmonic structure is relatively poor. Therefore, the method for setting is effective such that the search range for a higher subband is biased toward a lower frequency band.

In addition, pitch coefficient setting section 294 sets pitch coefficient T for only the second subband and the fourth subband based on optimal pitch coefficient $T_{p-1}'$ searched in the previous neighboring subband (the lower neighboring subband.) That is, pitch coefficient setting section 294 sets pitch coefficient T for the subband only one subband apart based on optimal pitch coefficient $T_{p-1}'$ searched in the previous neighboring subband. By this means, it is possible to reduce the influence of the result of search for a low frequency subband on search for all frequency subbands higher than the low frequency subband, so that it is possible to prevent the value of pitch coefficient T set for a high frequency subband from being too large. That is, it is possible to prevent the search range for a higher frequency subband from being limited to a higher frequency band. By this means, it is possible to prevent search for an optimal pitch coefficient in a band, which is less likely to be similar, and prevent quality deterioration of a decoded signal due to reduced efficiency of coding.

Figure 18:
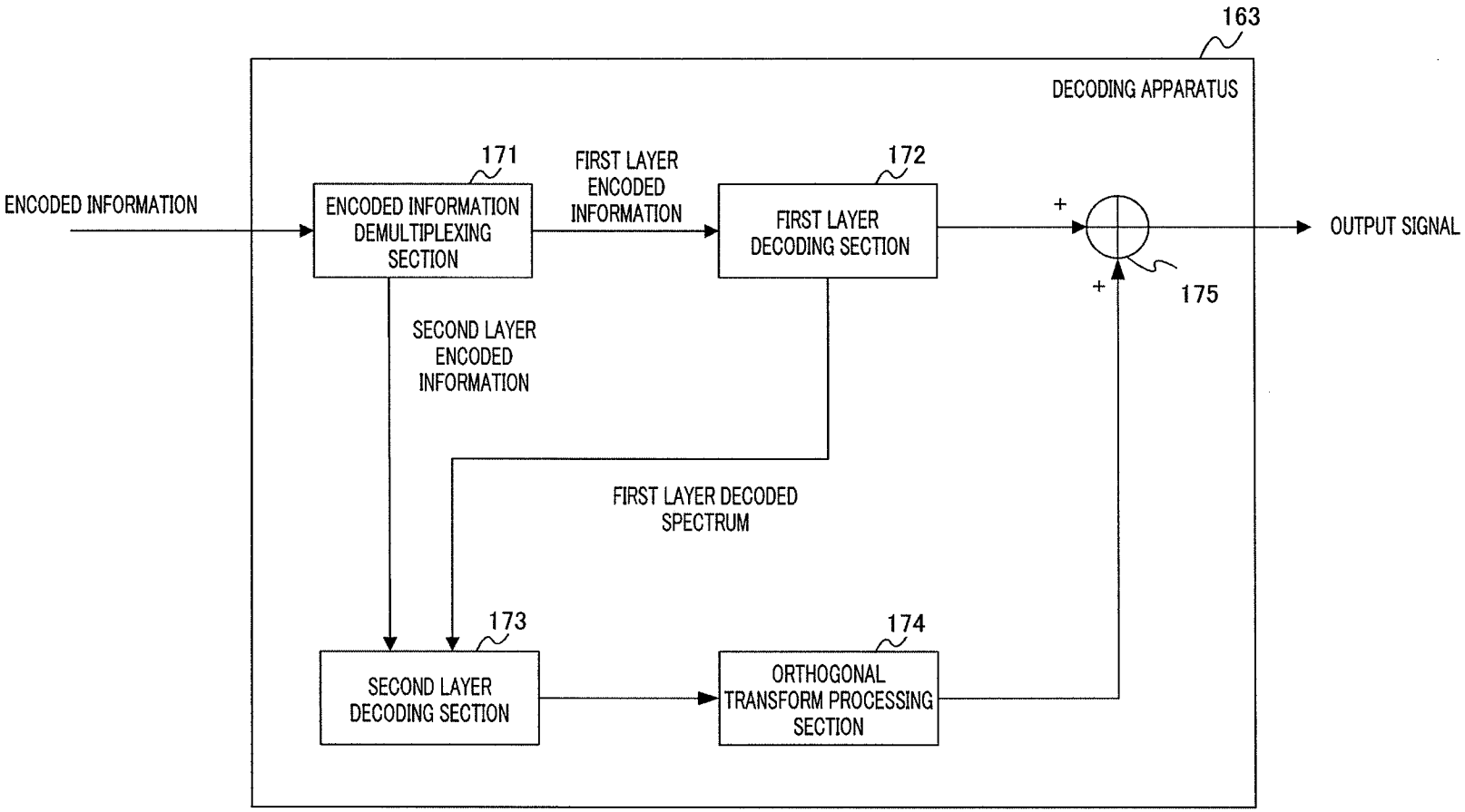
FIG. 18 is a block diagram showing primary parts in a decoding apparatus according to Embodiment 4 of the present invention.

FIG. 18 is a block diagram showing primary parts in decoding apparatus 163 according to the present embodiment. Decoding apparatus 163 according to the preset embodiment is composed mainly of encoded information demultiplexing section 171, first layer decoding section 172, second layer decoding section 173, orthogonal transform processing section 174 and adding section 175.

In FIG. 18, encoded information demultiplexing section 171 demultiplexes first layer encoded information and second layer encoded information from the inputted encoded information, outputs the first layer encoded information to first layer decoding section 172 and outputs the second layer encoded information to second layer decoding section 173.

First layer decoding section 172 decodes the first layer encoded information inputted from encoded information demultiplexing section 171 using the G.729.1 speech coding method and outputs the generated first layer decoded signal to adding section 175. In addition, first layer decoding section 172 outputs a first layer decoded spectrum obtained in the process of generating the first layer decoded signal to second layer decoding section 173. Here, operations of first layer decoding section 172 will be described in detail later.

Second layer decoding section 173 decodes the spectrum of the higher frequency band using the first layer decoded spectrum inputted from first layer decoding section 172 and the second layer decoded information inputted from encoded information demultiplexing section 171 and outputs a generated second layer decoded spectrum to orthogonal transform processing section 174. Processing in second layer decoding section 173 is the same as in second layer decoding section 135 shown in FIG. 7 except for signals received as input and the source from which the signals are transmitted, so that detailed descriptions will be omitted. Here, operations of second layer decoding section 173 will be described in detail later.

Orthogonal transform processing section 174 performs orthogonal transform processing (IMDCT) on the second layer decoded spectrum inputted from second layer decoding section 173 and outputs an obtained second layer decoded signal to adding section 175. Here, operations in orthogonal transform processing section 174 are the same as in orthogonal transform processing section 356 shown in FIG. 8 except for a signal received as input and the source from which the signal is transmitted, so that detailed descriptions will be omitted.

Adding section 175 adds the first layer decoded signal inputted from first layer decoding section 172 and the second layer decoded signal inputted from orthogonal transform processing section 174 and outputs the resulting signal as an output signal.

Figure 19:
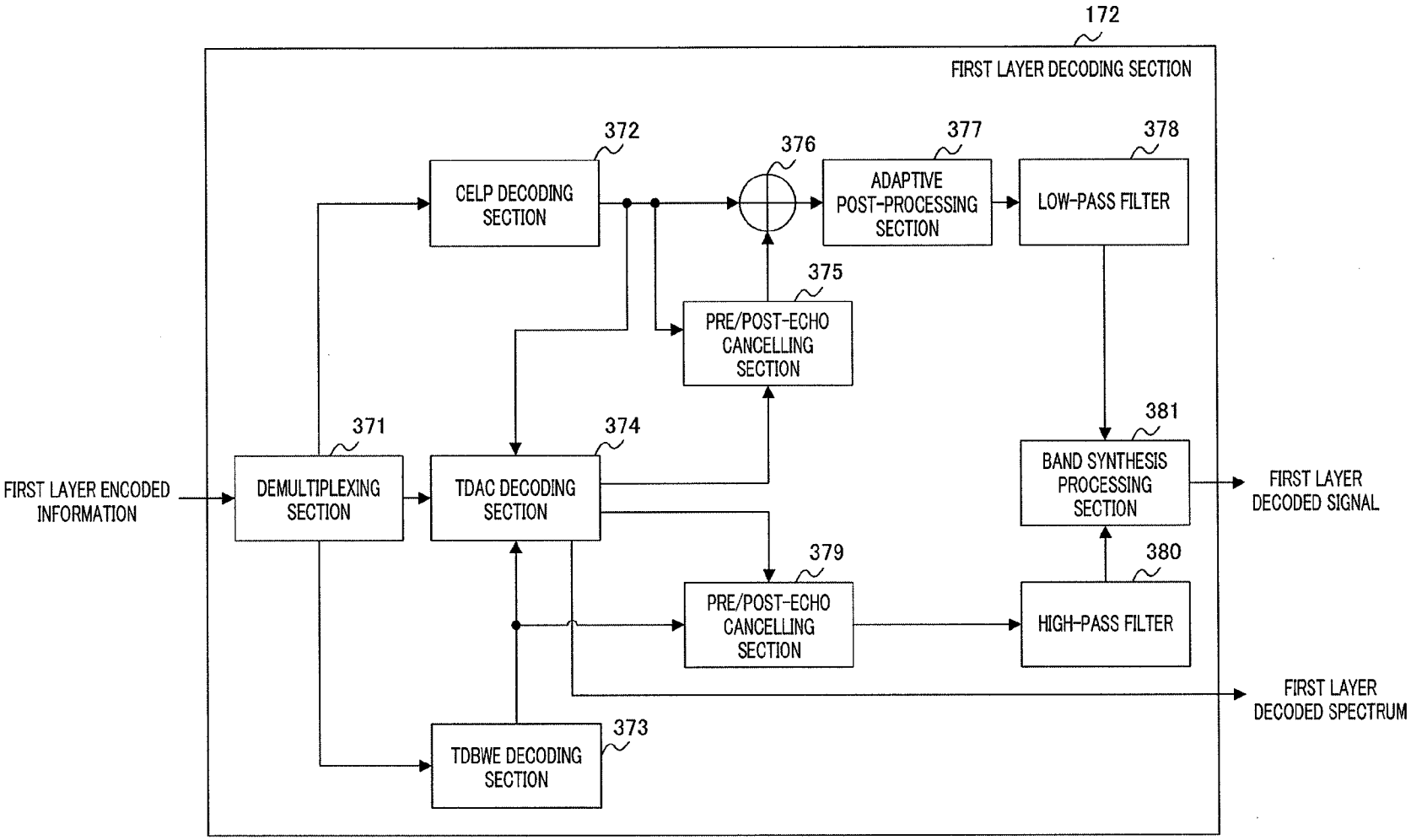
FIG. 19 is a block diagram showing primary parts in the first layer decoding section shown in FIG. 18.

FIG. 19 is a block diagram showing primary parts in first layer decoding section 172 shown in FIG. 18. Here, a configuration will be explained as an example where first layer decoding section 172 corresponding to first layer coding section 233 shown in FIG. 15 performs G.729.1 decoding standardized by ITU-T. Here, FIG. 19 shows the configuration of first layer decoding section 172 where there is no frame error at the time of transmission, and therefore a part for frame error compensation processing is not shown in the figure and descriptions will be omitted. Here, the present invention is applicable to a case in which a frame error occurs.

First layer decoding section 172 includes demultiplexing section 371, CELP decoding section 372, TDBWE decoding section 373, TDAC decoding section 374, pre/post-echo cancelling section 375, adding section 376, adaptive post-processing section 377, low-pass filter 378, pre/post-echo cancelling section 379, high-pass filter 380 and band synthesis processing section 381, and these sections perform the following operations, respectively.

Demultiplexing section 371 demultiplexes first layer encoded information inputted from encoded information demultiplexing section 171 (FIG. 18) into CELP parameters, TDAC parameters and TDBWE parameters, outputs the CELP parameters to CELP decoding section 372, outputs the TDAC parameters to TDAC decoding section 374 and outputs the TDBWE parameters to TDBWE decoding section 373. Here, encoded information demultiplexing section 171 may demultiplex these parameters without providing demultiplexing section 371.

CELP decoding section 372 performs CELP decoding using the CELP parameters inputted from demultiplexing section 371 and outputs the resulting decoded signal to TDAC decoding section 374, adding section 376 and pre/post-echo cancelling section 375 as a decoded CELP signal. Here, CELP decoding section 372 may output other information obtained in the process of generating the decoded CELP signal from the CELP parameters to TDAC decoding section 374.

TDBWE decoding section 373 decodes the TDBWE parameters inputted from demultiplexing section 371 and outputs an obtained decoded signal to TDAC decoding section 374 and pre/post-echo cancelling section 379 as a decoded TDBWE signal.

TDAC decoding section 374 calculates a first layer decoded spectrum using the TDAC parameters inputted from demultiplexing section 371, the decoded CELP signal inputted from CELP decoding section 372 and the decoded TDBWE signal inputted from TDBWE decoding section 373. Then, TDAC decoding section 374 outputs the calculated first layer decoded spectrum to second layer decoding section 173 (FIG. 18). Here, the obtained first layer decoded spectrum is the same as the first layer decoded spectrum calculated in first layer coding section 233 (FIG. 15) in coding apparatus 161. In addition, TDAC decoding section 374 performs orthogonal transform processing such as MDCT in the band from 0 to 4 kHz and the band from 4 to 8 kHz in the calculated first layer decoded spectrum, and calculates a decoded first TDAC signal (in the band from 0 to 4 kHz) and a decoded second TDAC signal (in the band from 4 to 8 kHz). TDAC decoding section 374 outputs the calculated decoded first TDAC signal to pre/post-echo cancelling section 375 and outputs the calculated decoded second TDAC signal to pre/post-echo cancelling section 379.

Pre/post-echo cancelling section 375 cancels pre/post-echo from the decoded CELP signal inputted from CELP decoding section 372 and the decoded first TDAC signal inputted from TDAC decoding section 374 and outputs signals after echo cancellation to adding section 376.

Adding section 376 adds the decoded CELP signal inputted from CELP decoding signal 372 and the signal after echo cancellation inputted from pre/post-echo cancelling section 375, and outputs an obtained added signal to adaptive post-processing section 377.

Adaptive post processing section 377 performs post-processing adaptively on the added signal inputted from adding section 376 and outputs an obtained decoded first low frequency band signal (in the band from 0 to 4 kHz) to low-pass filter 378.

Low-pass filter 378 removes frequency components higher than 4 kHz of the decoded first low frequency band signal inputted from adaptive post-processing section 37 to obtain a signal composed mainly of frequency components equal to or lower than 4 kHz and outputs the signal to band synthesis processing section 381 as a decoded first low frequency band signal after filtering.

Pre/post-echo cancelling section 379 performs pre/post-echo cancellation on the decoded second TDAC signal inputted from TDAC decoding section 374 and decoded TDBWE signal inputted from TDBWE decoding section 373, and outputs the signal after echo cancellation to high-pass filter 380 as a decoded second low frequency band signal (in the band from 4 to 8 kHz).

High-pass filter 380 removes frequency components of the decoded second low frequency band signal lower than 4 kHz inputted from pre/post-echo cancelling section 379 to obtain a signal composed mainly of frequency components higher than 4 kHz and outputs the signal to band synthesis processing section 381 as a decoded second low frequency band signal after filtering.

Band synthesis processing section 381 receives, as input, the decoded first low frequency band signal after filtering from low-pass filter 378 and the decoded second low frequency band signal after filtering from high-pass filter 380. Band synthesis processing section 381 performs band synthesis processing on the decoded first low frequency band signal after filtering (in the band from 0 to 4 kHz) and the decoded second low frequency band signal after filtering (in the band from 4 to 8 kHz) both having a sampling frequency of 8 kHz, to generate a first layer decoded signal having a sampling frequency of 16 kHz (in the band from 0 to 8 kHz). Then, band synthesis processing section 381 outputs the generated first layer decoded signal to adding section 175.

Here, band synthesis processing may be performed in adding section 175 without providing band synthesis processing section 381.

Decoding in first layer decoding section 172 according to the present embodiment shown in FIG. 19 differs from G.729. decoding only in that TDA decoding section 374 outputs a first layer decoded spectrum to second layer decoding section 173 at the time of calculating the first layer decoded spectrum based on TDAC parameters.

Figure 20:
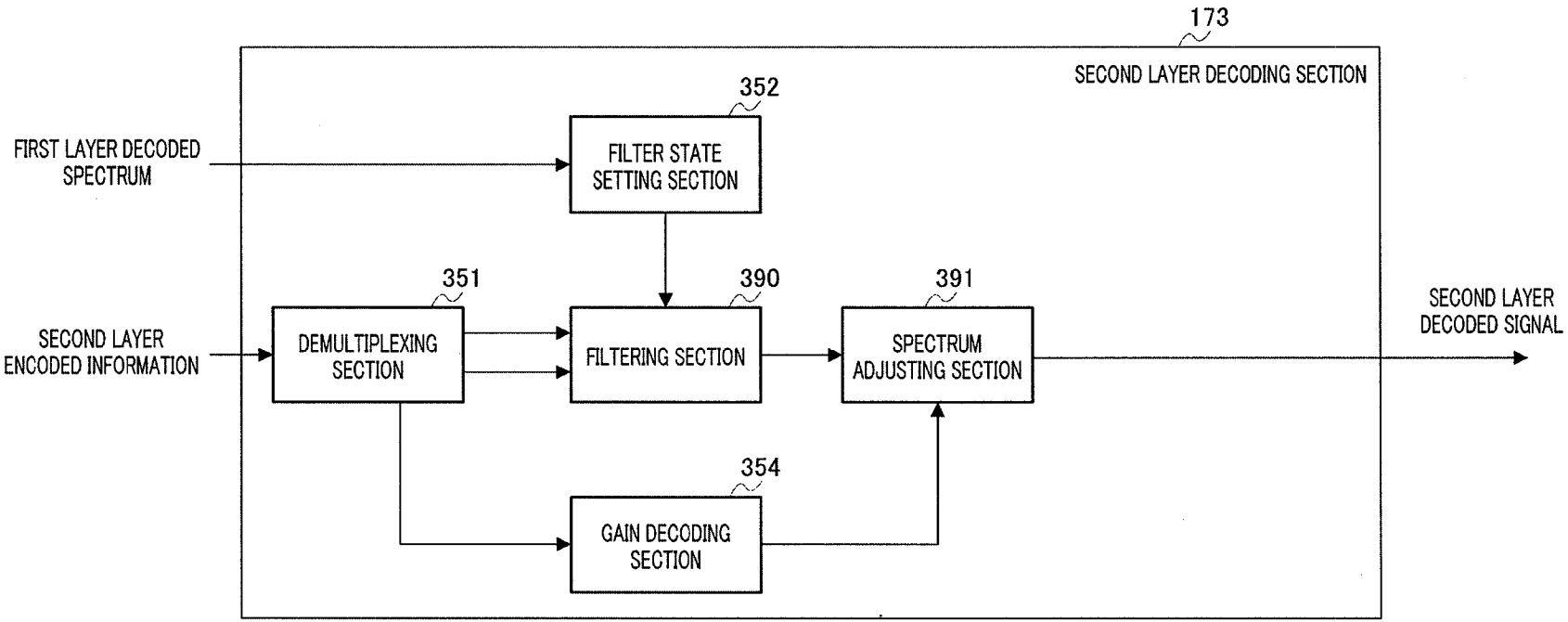
FIG. 20 is a block diagram showing primary parts in the second layer decoding section shown in FIG. 18.

FIG. 20 is a block diagram showing primary parts in second layer decoding section 173 shown in FIG. 18. The internal configuration of second layer decoding section 173 shown in FIG. 20 removes orthogonal transform processing section 356 from second layer decoding section 135 shown in FIG. 8. Parts in second layer decoding section 173 are the same as in second layer decoding section 135 except for filtering section 390 and spectrum adjusting section 391, so that descriptions will be omitted.

Filtering section 390 has a multi-tap pitch filter in which the number of taps is more than one. Filtering section 390 filters first decoded spectrum S1($k$) based on band division information inputted from demultiplexing section 351, the filter state set by filter state setting section 352, pitch coefficient $T_p'$(p=0, 1, . . . , P−1) inputted from demultiplexing section 351 and a filter coefficient stored inside in advance, and calculates estimation value $S2_p'(k)(BS_p \leqq k < BS_p + BW_p)$ (p=0, 1, . . . , P−1) for each subband $SB_p$(p=0, 1, . . . , P−1) shown in equation 16. The filter function shown in equation 15 is also used in filtering section 390. Here, in the filter processing and the filter function, T in equation 15 and equation 16 is replaced with $T_p'$.

Here, filtering section 390 performs filtering processing on first subband, third subband and fifth subband $SB_p$(p=0, 2, 4) using pitch coefficients $T_p'$(p=0, 2, 4) as is. In addition, filtering section 390 newly sets pitch coefficient $T_p''$ for second subband and fourth subband $SB_p$(p=1, 3), taking into account pitch coefficient $T_{p-1}'$ for subband $SB_{p-1}$ and filters second subband and fourth subband $SB_p$(p=1, 3) using this pitch coefficient $T_p''$. To be more specific, when filtering second subband and fourth subband $SB_p$(p=1, 3), filtering section 390 calculates pitch coefficient $T_p''$ used for filtering by applying pitch coefficient $T_{p-1}'$ and bandwidth $BW_{p-1}$ of subband $SB_{p-1}$(p=1, 3) to the pitch coefficient obtained from demultiplexing section 351, according to equation 18. Filtering processing in this case is performed according to an equation replacing T in equation 16 with $T_p''$.

In equation 18, pitch coefficient $T_p''$ is calculated for subbands $SB_p$(p=1, 2, . . . , P−1) by adding bandwidth $BW_{p-1}$ of subband $SB_{p-1}$ to pitch coefficient $T_{p-1}'$ of subband $SB_{p-1}$ and adding $T_p'$ to the index resulting from subtracting a value half the search range SEARCH.

Spectrum adjusting section 391 calculates estimated spectrum S2'($k$) of an input spectrum by using estimated spectrum $S2_p'(k)$(p=0, 1, . . . , P−1) of subbands $SB_p$(p=0,1, . . . , P−1) inputted from filtering section 390, which are continued in the frequency domain. In addition, spectrum adjusting section 391 multiplies estimated spectrum S2'($k$) by amount of variation $VQ_j$ per subband inputted from gain decoding section 354 according to equation 19. By this means, spectrum adjusting section 391 adjusts the spectral shape of estimated spectrum S2'($k$) in the frequency band $FL \leqq k < FH$ to generate decoded spectrum S3($k$). Next, spectrum adjusting section 391 makes the value of the low frequency band of $0 \leqq k < FL$ of decoded spectrum S3($k$) "0". Then, spectrum adjusting section 391 outputs a decoded spectrum in which the value of the low frequency band of $0 \leqq k < FL$ is "0", to orthogonal transform processing section 174.

As described above, according to the present embodiment, in coding/decoding to estimate the spectrum of the higher frequency band by performing band extension using the spectrum of the lower frequency band, the higher frequency band is divided into a plurality of subbands, and, in part of subbands (the first subband, the third subband and the fifth subband in the present embodiment), search is performed in the search range set for each subband. In addition, in the other subbands (the second subband and the fourth subband in the present embodiment), search is performed using the coding results of respective previous neighboring subbands. By this means, it is possible to more efficiently encode/decode the higher frequency band spectrum by performing efficient search using correlation between subbands and prevent noise caused by biasing a search range toward a higher frequency band, and consequently, it is possible to improve the quality of a decoded signal.

(Embodiment 5)

With Embodiment 5 of the present invention, a configuration will be described where the sampling frequency of an input signal is 32 kHz in the same way as in Embodiment 4 and the G.729.1 coding method standardized by ITU-T is applied as a coding method used in the first layer coding section.

The communication system (not shown) according to Embodiment 5 of the present invention is basically the same as the communication system shown in FIG. 2, but the configurations and operations of the coding apparatus and decoding apparatus differ only in part from those of coding apparatus 101 and decoding apparatus 103 in the communication system shown in FIG. 2. Now, the coding apparatus and the decoding apparatus in the communication system according to the present embodiment will be assigned reference numerals "181" and "184," respectively, and explained.

Coding apparatus 181 (not shown) according to the present embodiment is basically the same as coding apparatus 161 shown in FIG. 15 and composed mainly of downsampling processing section 201, first layer coding section 233, orthogonal transform processing section 215, second layer coding section 246 and encoded information multiplexing section 207. Here, parts except for second layer coding section 246 are the same as in Embodiment 4 and descriptions will be omitted.

Second coding section 246 generates second encoded information using an input spectrum inputted from orthogonal transform processing section 215 and a first layer decoded spectrum inputted from first layer coding section 233 and outputs the generated second layer encoded information to encoded information multiplexing section 207. Here, second layer coding section 246 will be described in detail later.

Figure 21:
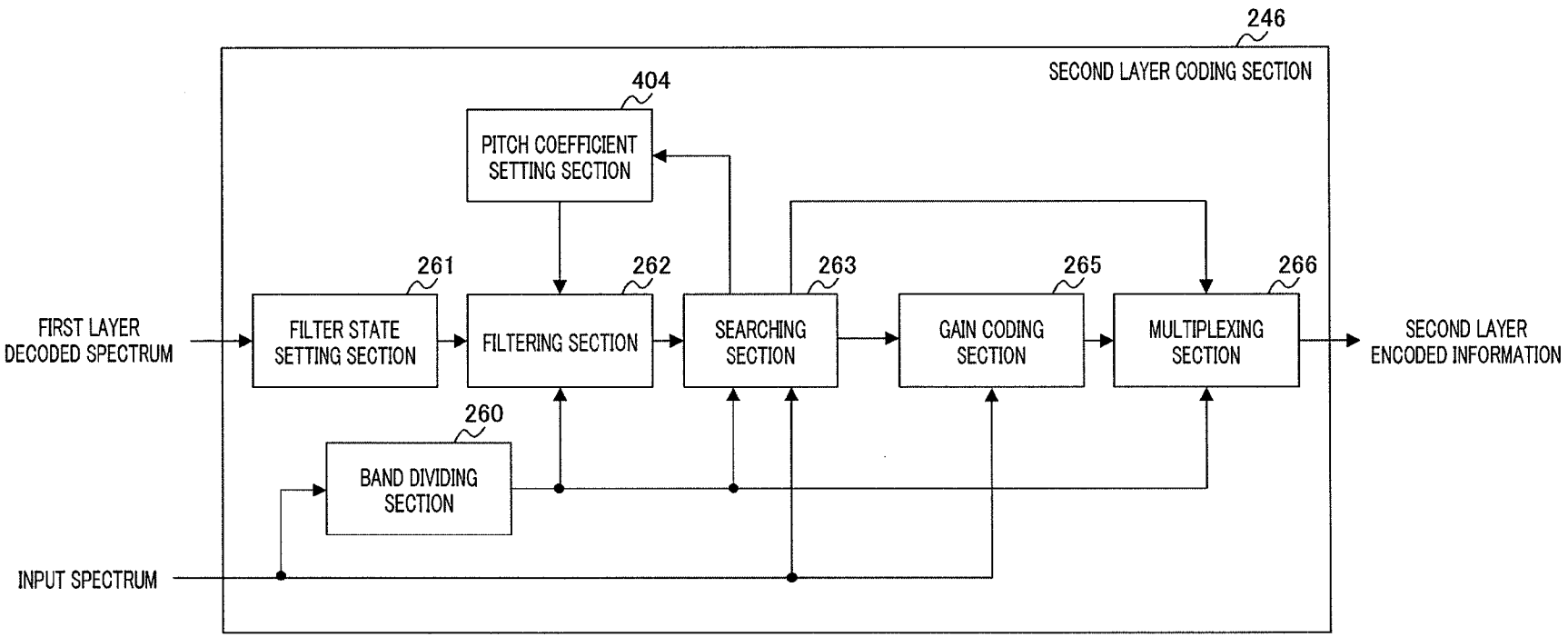
FIG. 21 is block diagram showing primary parts in a second layer coding section according to Embodiment 5 of the present invention.

FIG. 21 is a block diagram showing primary parts in second layer coding section 246 according to the present embodiment.

Parts except for pitch coefficient setting section 404 in second layer coding section 246 are the same as in Embodiment 4, so that descriptions will be omitted.

In addition, in the same way as in Embodiment 4, a case will be described as an example where band dividing section 260 shown in FIG. 21 divides the higher frequency band ($FL \leqq k < FH$) of input spectrum S2($k$) into five subbands $SB_p$ ($p=0, 1, \ldots, 4$). That is, a case will be described here the number of subbands P in Embodiment 1 is five (P=5). Here, the present embodiment does not limit the number of subbands resulting from dividing the higher frequency band of input spectrum S2 and is equally applicable to cases in which the number of subbands P is not five ($P \neq 5$).

Pitch coefficient setting section 404 sets in advance pitch coefficient search ranges for part of a plurality of subbands and sets pitch coefficient search ranges for the other subbands based on the search results for respective previous neighboring subbands.

For example, performing closed-loop search processing for first subband $SB_0$, third subband $SB_2$, or fifth subband $SB_4$ (subband $SB_p$($p=0, 2, 4$)) with filtering section 262 and searching section 263 under the control of searching section 263, pitch coefficient setting section 404 sequentially outputs pitch coefficient T to filtering section 262 by changing pitch coefficient T little by little in a predetermined search range. To be more specific, when performing a closed loop search processing for first subband $SB_0$, pitch coefficient setting section 404 sets pitch coefficient T for first subband $SB_0$ by changing pitch coefficient T little by little in the search range set in advance for the first subband from Tmin1 to Tmax1. In addition, when performing closed-loop search processing for third subband $SB_2$, pitch coefficient setting section 404 sets pitch coefficient T for third subband $SB_2$ by changing pitch coefficient T little by little in the search range set in advance for the third subband from Tmin3 to Tmax3. Likewise, when performing closed-loop search processing for fifth subband $SB_4$, pitch coefficient setting section 404 sets pitch coefficient T for fifth subband $SB_4$ by changing pitch coefficient T little by little in the search range set in advance for the fifth subband from Tmin5 to Tmax5.

Meanwhile, performing closed-loop search processing for second subband $SB_1$ or fourth subband $SB_3$ (subband $SB_p$ ($p=1, 3$)) with filtering section 262 and searching section 263 under the control of searching section 263, pitch coefficient setting section 404 sequentially outputs pitch coefficient T to filtering section 262 by changing pitch coefficient T little by little, based on optimal pitch coefficient $T_{p-1}'$ calculated in the closed-loop search processing for previous neighboring subband $SB_{p-1}$. To be more specific, when pitch coefficient setting section 404 performs closed-loop search processing for second subband $SB_1$, if the value of optimal pitch coefficient $T_0'$ of previous neighboring first subband $SB_0$ is lower than predetermined threshold $TH_p$ (pattern 1), pitch coefficient setting section 404 sets pitch coefficient T by changing pitch coefficient T little by little in the search range calculated according to equation 27. Meanwhile, when the value of optimal pitch coefficient $T_0'$ of first subband $SB_0$ is equal to or higher than predetermined threshold $TH_p$ (pattern 2), pitch coefficient setting section 404 sets pitch coefficient T by changing pitch coefficient T little by little in the search range calculated according to equation 28. In these cases, P is one (P=1) in equation 27 and equation 28. Here, SEARCH 1 and SEARCH 2 in equation 27 and equation 28 are setting ranges of predetermined search pitch coefficients, respectively. Now, a case of SEARCH 1>SEARCH 2 will be described.

[27]

$$T_{p-1}'+BW_{p-1}-\text{SEARCH1}/2 \leqq T \leqq T_{p-1}'+BW_{p-1}+\text{SEARCH1}/2 \ (\text{if}\ (T_0'<TH)) \quad \text{(Equation 27)}$$

[28]

$$T_{p-1}'+BW_{p-1}-\text{SEARCH2}/2 \leqq T \leqq T_{p-1}'+BW_{p-1}+\text{SEARCH2}/2 \ (\text{if}\ (T_0' \geqq TH)) \quad \text{(Equation 28)}$$

Likewise, when pitch coefficient setting section 404 performs closed-loop search processing for fourth subband $SB_3$, if the value of optimal pitch coefficient $T_0'$ of first subband $SB_0$ is lower than predetermined threshold $TH_p$ (pattern 1), pitch coefficient setting section 404 sets pitch coefficient T by changing pitch coefficient T little by little in the search range calculated according to equation 29, based on optimal pitch coefficient $T_2'$ of previous neighboring third subband $SB_2$. Meanwhile, when the value of optimal pitch coefficient $T_0'$ of first subband $SB_0$ is equal to or higher than predetermined threshold $TH_p$ (pattern 2), pitch coefficient setting section 404 sets pitch coefficient T by changing pitch coefficient T little by little in the search range calculated according to equation 30. In these cases, P is three (P=3) in equation 29 and equation 30.

[29]

$$T_{p-1}'+BW_{p-1}-\text{SEARCH2}/2 \leqq T \leqq T_{p-1}'+BW_{p-1}+\text{SEARCH1}/2 \ (\text{if}\ (T_0'<TH)) \quad \text{(Equation 29)}$$

[30]

$$T_{p-1}'+BW_{p-1}-\text{SEARCH1}/2 \leqq T \leqq T_{p-1}'+BW_{p-1}+\text{SEARCH1}/2 \ (\text{if}\ (T_0'<TH)) \quad \text{(Equation 30)}$$

Here, when the value of the range of pitch coefficient T set according to equation 27 to equation 30 is higher than the upper limit of the band of the first layer decoded spectrum, the range of pitch coefficient T is corrected as shown in equation 31 and equation 32 in the same way as in Embodiment 1. At this time, equation 31 corresponds to equation 27 and equation 30, and equation 32 corresponds to equation 28 and equation 29. Likewise, when the value of the range of pitch coefficient T set according to equation 27 to equation 30 is lower than the lower limit of the band of the first layer decoded spectrum, the range of pitch coefficient T is corrected as shown in equation 33 and equation 34 in the same way as in Embodiment 1. At this time, equation 33 corresponds to equation 27 and equation 30, and equation 34 corresponds to equation 28 and equation 29. Thus, by correcting the range to search for pitch coefficient T, it is possible to perform efficient coding without reducing the number of entries in search for an optimal pitch coefficient.

[31]

$$\text{SEARCH_MAX}-\text{SEARCH1} \leqq T \leqq \text{SEARCH_MAX} \quad (\text{if } (T_{p-1}'+BW_{p-1}+\text{SEARCH1}/2>\text{SEARCH_MAX})) \qquad \text{(Equation 31)}$$

[32]

$$\text{SEARCH_MAX}-\text{SEARCH2} \leqq T \leqq \text{SEARCH_MAX} \quad (\text{if } (T_{p-1}'+BW_{p-1}+\text{SEARCH2}/2>\text{SEARCH_MAX})) \qquad \text{(Equation 32)}$$

[33]

$$0 \leqq T \leqq \text{SEARCH1} \ (\text{if } (T_{p'1}'+BW_{p-1}-\text{SEARCH1}/2<\text{SEARCH_MIN})) \qquad \text{(Equation 33)}$$

[34]

$$0 \leqq T \leqq \text{SEARCH2} \ (\text{if } (T_{p-1}'+BW_{p-1}-\text{SEARCH2}/2<\text{SEARCH_MIN})) \qquad \text{(Equation 34)}$$

Pitch coefficient setting section 404 adaptively changes the number of entries at the time of searching for the optimal pitch coefficients for the second subband and the fourth subband. That is, when optimal pitch coefficient $T_0'$ of the first subband is lower than a preset threshold, pitch coefficient setting section 404 increases the number of entries at the time of searching for the optimal pitch coefficient for the second subband (pattern 1), and, when optimal pitch coefficient $T_0'$ of the first subband is equal to or higher than a preset threshold, decreases the number of entries at the time of searching for the optimal pitch coefficient for the second subband (pattern 2). In addition, pitch coefficient setting section 404 increases and decreases the number of entries at the time of searching for the optimal pitch coefficient for the fourth subband in accordance with the pattern (pattern 1 or pattern 2) at the time of searching for the optimal pitch coefficient for the second subband. To be more specific, pitch coefficient setting section 404 decreases the number of entries at the time of searching for the optimal pitch coefficient for the fourth subband in pattern 1, and increases the number of entries at the time of searching for the optimal pitch coefficient for the fourth subband in pattern 2. At this time, the total number of the entries at the time of searching for the optimal pitch coefficient for the second subband and the entries at the time of searching for the optimal pitch coefficient for the fourth subband are the same between pattern 1 and pattern 2, so that it is possible to more efficiently search for an optimal pitch coefficient while the bit rate is fixed.

When an input signal is a speech signal and so forth, the first layer decoded spectrum is characterized in that its periodicity increases in the lower frequency band. Therefore, the effect due to an increase in the number of entries at the time of search is improved when the range to search for an optimal pitch coefficient is the lower frequency band. Therefore, as described above, when the value of the optimal pitch coefficient searched for the first subband is small, it is possible to more effectively search for the optimal pitch coefficient for the second subband by increasing the number of entries at the time of searching for the optimal pitch coefficient for the second subband. At this time, the number of entries at the time of searching for the optimal pitch coefficient for the fourth subband is decreased. On the other hand, when the value of the optimal pitch coefficient searched for the first subband is large, an increase in the number of entries at the time of searching for the optimal pitch coefficient for the second subband provides little effect. Therefore, the number of entries at the time of searching for the optimal pitch coefficient for the second subband is decreased while the number of entries at the time of searching for the optimal pitch coefficient for the fourth subband is increased. As described above, it is possible to more efficiently search for optimal pitch coefficients by adjusting the number of entries (bit allocation) at the time of searching for the optimal pitch coefficient between the second subband and the fourth subband in accordance with the value of the optimal pitch coefficient searched for the first subband, so that it is possible to generate a decoded signal with high quality.

Primary parts in decoding apparatus 184 (not shown) according to the present embodiment are basically the same as in decoding apparatus 163 shown in FIG. 18, so that descriptions will be omitted.

As described above, according to the present embodiment, in coding/decoding to estimate the spectrum of the higher frequency band by performing band extension using the spectrum of the lower frequency band, the higher frequency band is divided into a plurality of subbands, and, in part of subbands (the first subband, the third subband and the fifth subband in the present embodiment), search is performed in the search range set for each subband. In addition, in the other subbands (the second subband and the fourth subband in the present embodiment), search is performed using the coding results of respective previous neighboring subbands. Here, when the optimal pitch coefficients are searched for the second subband and the fourth subband, respectively, the number of entries for search is adaptively switched based on the optimal pitch coefficient searched for the first subband. By this means, it is possible to use correlation between subbands and adaptively change the number of entries per subband, so that it is possible to more efficiently encode/decode the higher frequency band spectrum. As a result of this, it is possible to further improve the quality of a decoded signal.

Here, with the present embodiment, a case has been described as an example where the total number of entries at the time of searching for the optimal pitch coefficients for the second subband and the fourth subband is the same. However, the present invention is not limited to this, and is applicable to a configuration in which the total number of entries at the time of searching for the optimal pitch coefficients for the second subband and the fourth subband differs between patterns.

In addition, with the present embodiment, although a case has been described as an example where the number of entries at the time of searching for the optimal pitch coefficients for the second subband and the fourth subband increases and decreases, the present invention is equally applicable to a case in which the search range covers all the low frequency bands by increasing the number of entries for search.

In addition, with the present embodiment, as an example for a case in which the number of entries at the time of searching for the optimal pitch coefficients for the second subband and the fourth subband increases and decreases, a configuration has been explained where, when the value of optimal pitch coefficient $T_0'$ of the first subband is lower than predetermined threshold $TH_p$ (pattern 1), the number of entries at the time of searching for the optimal pitch coefficient for the second subband is increased (the search range is widened) and the number of entries at the time of searching for the optimal pitch coefficient for the fourth subband is decreased (the search range is narrowed). Moreover, when the value of optimal pitch coefficient $T_0'$ of the first subband is equal to or higher than predetermined threshold $TH_p$ (pattern 2), the above-described configuration adopts a search range setting method opposite to the above-description. However, the present invention is not limited to the above-described configuration and equally applicable to a configuration to adopt a method of setting a search range for the first subband in the opposite way for each of pattern 1 and pattern 2. That is, the present invention is equally applicable to a configuration in which, when the value of optimal pitch coefficient $T_0'$ of the first subband is lower than predetermined threshold $TH_p$ (pattern 1), the number of entries at the time of searching for the optimal pitch coefficient for the second subband is deceased (the search range is narrowed) and the number of entries at the time of searching for the optimal pitch coefficient for the fourth subband is increased (the search range is widened). Here, when the value of optimal pitch coefficient $T_0'$ of the first subband is equal to or higher than predetermined threshold $TH_p$ (pattern 2), the present configuration adopts a search range setting method opposite to the above-description. By this configuration, it is possible to efficiently encode an input signal having the spectral characteristics significantly different between a lower frequency subband and a higher frequency subband in the lower frequency band. To be more specific, experiments have ascertained that it is possible to efficiently quantize an input signal having characteristics that its spectrum is composed of a plurality of peak components and the density of peak components significantly varies between bands.

(Embodiment 6)

With Embodiment 6 of the present invention, a configuration will be described where the sampling frequency of an input signal is 32 kHz in the same way as in Embodiment 4 and the G.729.1 coding method standardized by ITU-T is applied as a coding method used in the first layer coding section.

The communication system (not shown) according to Embodiment 6 of the present invention is basically the same as the communication system shown in FIG. 2, but the configurations and operations of the coding apparatus and decoding apparatus differ only in part from those of coding apparatus 101 and decoding apparatus 103 in the communication system shown in FIG. 2. Now, the coding apparatus and the decoding apparatus in the communication system according to the present embodiment will be assigned reference numerals "191" and "193," respectively, and explained.

Coding apparatus 191 (not shown) according to the present embodiment is basically the same as coding apparatus 161 shown in FIG. 15 and composed mainly of downsampling processing section 201, first layer coding section 233, orthogonal transform processing section 215, second layer coding section 256 and encoded information multiplexing section 207. Here, parts except for second layer coding section 256 are the same as in Embodiment 4 and descriptions will be omitted.

Second layer coding section 256 generates second layer encoded information using an input spectrum inputted from orthogonal transform processing section 215 and a first layer decoded spectrum inputted from first layer coding section 233 and outputs the generated second layer encoded information to encoded information multiplexing section 207. Here, second layer coding section 256 will be described in detail later.

Figure 22:
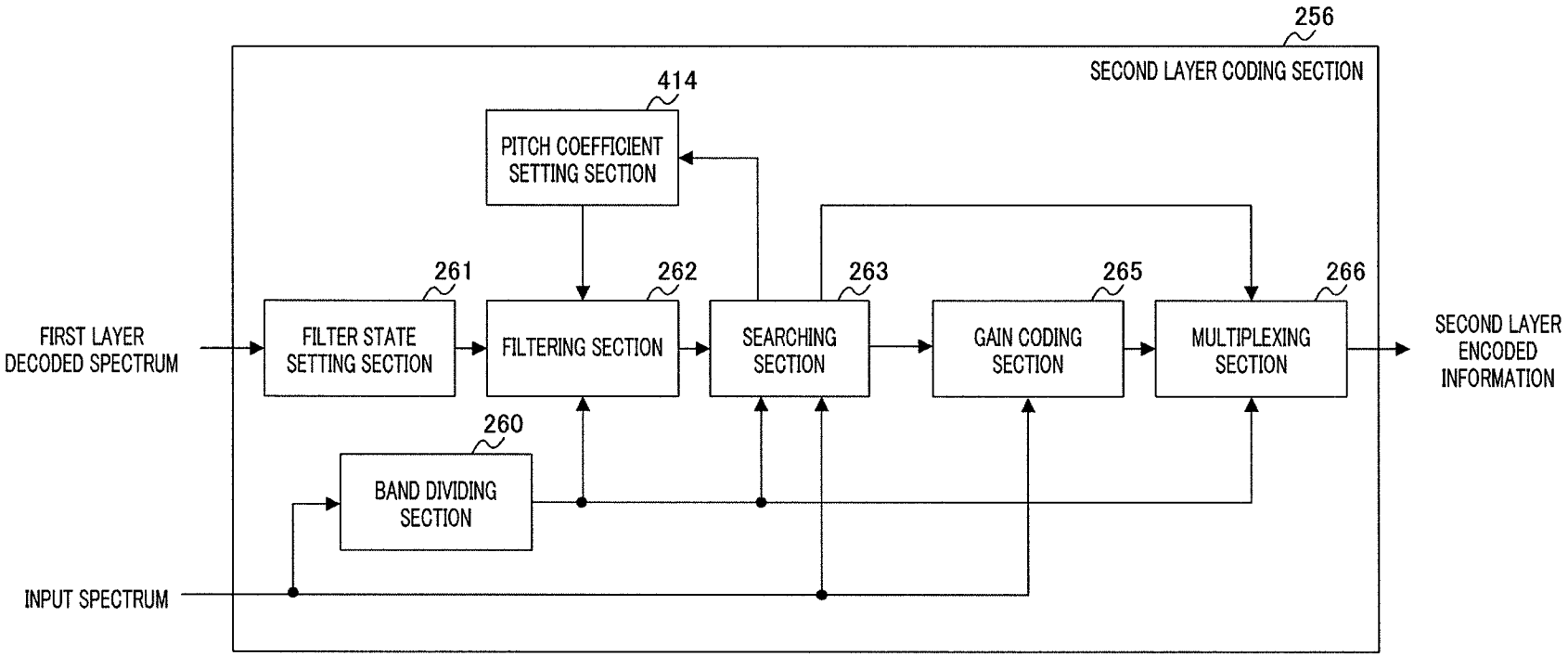
FIG. 22 is block diagram showing primary parts in a second layer coding section according to Embodiment 6 of the present invention.

FIG. 22 is a block diagram showing primary parts in second layer coding section 256 according to the present embodiment.

Parts except for pitch coefficient setting section 414 in second layer coding section 256 are the same as in Embodiment 4, so that descriptions will be omitted.

In addition, in the same way as in Embodiment 4, a case will be described as an example where band dividing section 260 shown in FIG. 22 divides the high frequency band ($FL \leqq k < FH$) of input spectrum $S2(k)$ into five subbands $SB_p$ ($p=0, 1, \ldots, 4$). That is, a case in which the number of subbands P is five ($P=5$) in Embodiment 1 will be described. Here, the present embodiment does not limit the number of subbands resulting from dividing the higher frequency band of input spectrum $S2(k)$ and is equally applicable to cases in which the number of subbands P is not five ($P \neq 5$).

Pitch coefficient setting section 414 sets pitch coefficient search ranges for part of a plurality of subbands in advance and sets pitch coefficient search ranges for the other subbands based on the search results of respective previous neighboring subbands.

For example, performing closed-loop search processing for first subband $SB_0$, third subband $SB_2$, or fifth subband $SB_4$ (subband $SB_p$($p=0,2,4$)) with filtering section 262 and searching section 263 under the control of searching section 263, pitch coefficient setting section 414 sequentially outputs pitch coefficient T to filtering section 262 by changing pitch coefficient T little by little in a predetermined search range. To be more specific, when performing a closed loop search processing for first subband $SB_0$, pitch coefficient setting section 414 sets pitch coefficient T for first subband $SB_0$ by changing pitch coefficient T little by little in the search range set in advance for the first subband from Tmin1 to Tmax1. In addition, when performing closed-loop search processing for third subband $SB_2$, pitch coefficient setting section 414 sets pitch coefficient T for third subband $SB_2$ by changing pitch coefficient T little by little in the search range set in advance for the third subband from Tmin3 to Tmax3. Likewise, when performing closed-loop search processing for fifth subband $SB_4$, pitch coefficient setting section 414 sets pitch coefficient T for fifth subband $SB_4$ by changing pitch coefficient T little by little in the search range set in advance for the fifth subband from Tmin5 to Tmax5.

Meanwhile, performing closed-loop search processing for second subband $SB_1$ or fourth subband $SB_3$ (subband $SB_p$ ($p=1,3$)) with filtering section 262 and searching section 263 under the control of searching section 263, pitch coefficient setting section 414 sequentially outputs pitch coefficient T to filtering section 262 by changing pitch coefficient T little by little, based on optimal pitch coefficient $T_{p-1}'$ calculated in the closed-loop search processing for previous neighboring subband $SB_{p-1}$. To be more specific, when pitch coefficient setting section 414 performs closed-loop search processing for second subband $SB_1$, if the value of optimal pitch coefficient $T_0'$ of first subband $SB_0$, which is the previous neighboring subband, is lower than predetermined threshold $TH_p$, pitch coefficient setting section 414 sets pitch coefficient T by changing pitch coefficient T little by little in the search range calculated according to equation 9. Here, P is one ($P=1$) in equation 9. On the other hand, when the value of optimal pitch coefficient $T_0'$ of first subband $SB_0$ is equal to or higher than predetermined threshold $TH_p$, pitch coefficient setting section 414 sets pitch coefficient T by changing pitch coefficient T little by little in a preset search range from Tmin2 to Tmax2.

Likewise, when pitch coefficient setting section 414 performs closed-loop search processing for fourth subband $SB_3$, if the value of optimal pitch coefficient $T_0'$ of first subband $SB_0$ is lower than predetermined threshold $TH_p$, pitch coefficient setting section 414 sets pitch coefficient T by changing pitch coefficient T little by little in the search range calculated according to equation 9, based on optimal pitch coefficient $T_2'$ of previous neighboring third subband $SB_2$. Here, P is three (P=3) in equation 9. On the other hand, when the value of optimal pitch coefficient $T_2'$ of third subband $SB_2$ is equal to or higher than predetermined threshold $TH_p$, pitch coefficient setting section 414 sets pitch coefficient T by changing pitch coefficient T little by little in a preset search range from Tmin4 to Tmax4.

Here, when the value of the range of pitch coefficient T set according to equation 9 is higher than the upper limit of the band of the first layer decoded spectrum, the range of pitch coefficient T is corrected as represented by equation 10 in the same way as in Embodiment 1. Likewise, the value of the range of pitch coefficient T set according to equation 9 is lower than the lower limit of the band of the first layer decoded spectrum, the range of pitch coefficient T is corrected as represented by equation 11 in the same way as in Embodiment 1. As described above, by correcting the range of pitch coefficient T, it is possible to perform efficient coding without reducing the number of entries in search for an optimal pitch coefficient.

Pitch coefficient setting section 414 adaptively change the setting of the search range at the time of searching for respective optimal pitch coefficients for the second subband and the fourth subband based on optimal pitch coefficient $T_{p-1}'$ calculated in the closed-loop search processing for previous neighboring subband $SB_{p-1}$. That is, only when optimal pitch coefficient $T_{p-1}'$ searched for previous neighboring subband $SB_{p-1}$ is lower than the threshold, pitch coefficient setting section 414 searches for the optimal pitch coefficient in the range based on optimal pitch coefficient $T_{p-1}'$. On the other hand, when optimal pitch coefficient $T_{p-1}'$ searched with respect to previous neighboring subband $SB_{p-1}$ is equal to or higher than the threshold, pitch coefficient setting section 414 searches for the optimal pitch coefficient in a preset search range. By this configuration, it is possible to prevent noise caused by biasing the range to search for an optimal pitch coefficient toward the higher frequency band, and consequently it is possible to improve the quality of a decoded signal.

Decoding apparatus 193 (not shown) is basically the same as decoding apparatus 163 shown in FIG. 18 and composed mainly of encoded information demultiplexing section 171, first layer decoding section 172, second layer decoding section 183, orthogonal transform processing section 174 and adding section 175. Here, parts except for second layer decoding section 183 are the same as in Embodiment 4, so that descriptions will be omitted.

Figure 23:
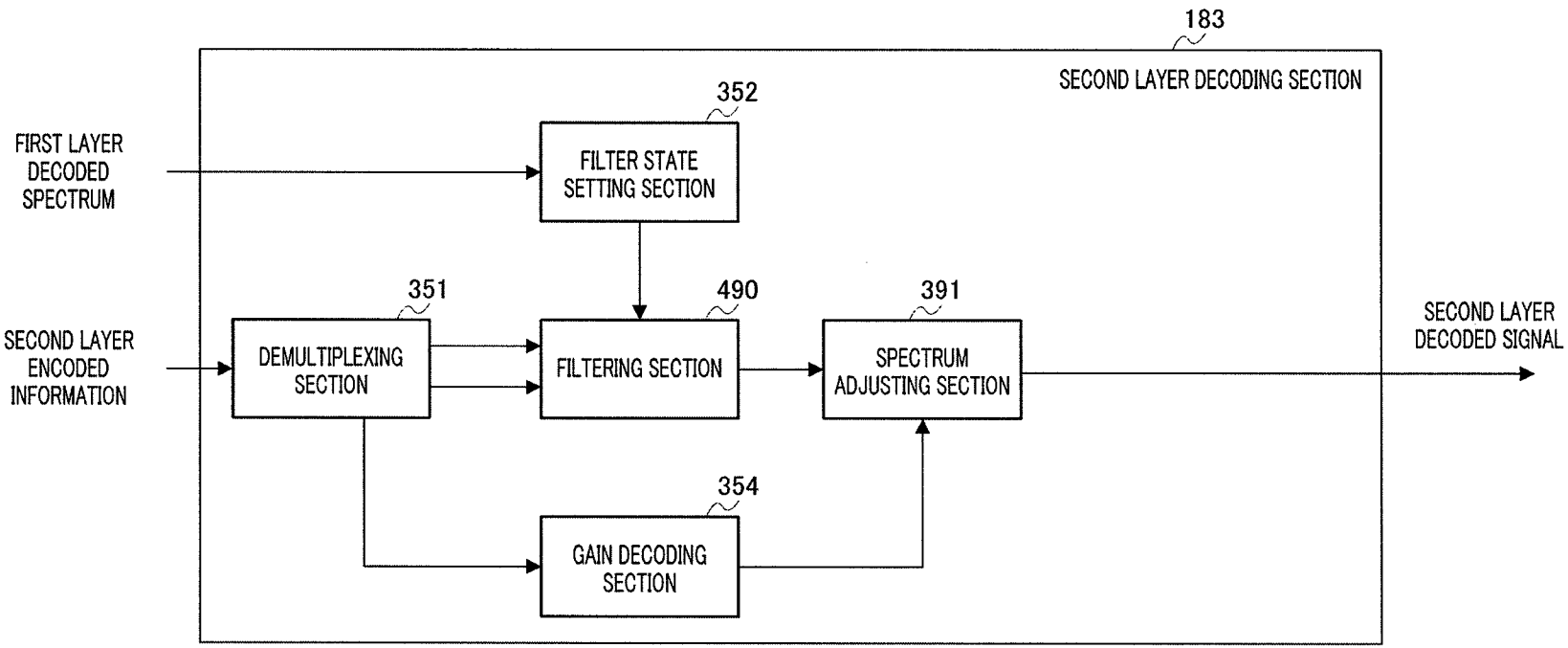
FIG. 23 is block diagram showing primary parts in a second layer decoding section according to Embodiment 6 of the present invention.

FIG. 23 is a block diagram showing primary parts in second layer decoding section 183 according to the present embodiment.

Parts except for filtering section 490 in second layer decoding section 183 are the same as in Embodiment 4, so that descriptions will be omitted.

Filtering section 490 has a multi-tap pitch filter in which the number of taps is greater than one Filtering section 490 filters first layer decoded spectrum S1($k$) based on band division information inputted from demultiplexing section 351, a filter state set by filter state setting section 352, pitch coefficient $T_p'$(p=0, 1, . . . , P−1) inputted from demultiplexing section 351 and a filter coefficient stored inside in advance, and calculates estimation value $S2_p'(k)(BS_p \leqq k < BS_p + BW_p)$ (p=0, 1, . . . , P−1) for each subband $SB_p$(p=0, 1, . . . , P−1) shown in equation 16. The filter function shown in equation 15 is also used in filtering section 490. Here, in the filter processing and the filter function, T in equation 15 and equation 16 is replaced with $T_p'$.

Here, filtering section 490 performs filtering processing on first subband, third subband and fifth subband $SB_p$(p=0, 2, 4) using pitch coefficient $T_p'$(p=0, 2, 4) as is. In addition, filtering section 490 newly sets pitch coefficient $T_p''$ for second subband and fourth subband $SB_p$(p=1, 3) taking into account pitch coefficient $T_{p-1}'$ of subband $SB_{p-1}$ and filters second subband and fourth subband $SB_p$(p=1, 3) using this pitch coefficient $T_p''$. To be more specific, when filtering section 490 filters second subband and fourth subband $SB_p$(p=1, 3), if the value of the pitch coefficient obtained from demultiplexing section 351 is lower than predetermined threshold $TH_p$, filtering section 490 calculates pitch coefficient $T_p''$ used for filtering by using pitch coefficient $T_{p-1}'$ and bandwidth $BW_{p-1}$ of subband $SB_{p-1}$(p=1, 3), according to equation 18. Here, in the filter processing and the filter function, T in equation 15 and equation 16 is replaced with $T_p'$. In addition, when filtering section 490 filters second subband and fourth subband $SB_p$(p=1, 3), if the value of the pitch coefficient obtained from demultiplexing section 351 is equal to or higher than predetermined threshold $TH_p$, filtering section 490 calculates estimation value $S2_p'(k)(BS_p \leqq k < BS_p + BW_p)$ (p=0, 1, . . . , P−1) for each subband $SB_p$(p=0, 1, . . . , P−1) represented by equation 16 by filtering first layer decoded spectrum S1($k$) based on pitch coefficient $T_p'$(p=0, 1, . . . , P−1) inputted from demultiplexing section 351 and a filter coefficient stored inside in advance. Here, in the filter processing and the filter function, T in equation 15 and equation 16 is replaced with $T_p'$.

As described above, according to the present embodiment, in coding/decoding to estimate the spectrum of the higher frequency band by performing band extension using the spectrum of the lower frequency band, the higher frequency band is divided into a plurality of subbands, and, in part of subbands (the first subband, the third subband and the fifth subband in the present embodiment), search is performed in the search range set for each subband. In addition, search is performed with respect to the other subbands (the second subband and the fourth subband in the present embodiment) using the coding results of respective previous neighboring subbands. Here, at the time of searching for optimal pitch coefficients for the second subband and the forth subband, the number of entries for search is adaptively varied based on the optimal pitch coefficient searched for the first subband. By this means, it is possible to use correlation between subbands and adaptively change the number of entries per subband, so that it is possible to more efficiently encode/decode the higher frequency band spectrum. As a result of this, it is possible to further improve the quality of a decoded signal.

Here, with the above-described Embodiments 4 to 6, a case has been described as an example where the G.729.1 coding/decoding method is used in the first layer coding section and the first layer decoding section. However, the present invention does not limit the coding/decoding method used in the first layer coding section and the first layer decoding section to the G.729.1 coding/decoding method. For example, the present invention is applicable to a configuration to adopt other coding/decoding methods such as G.718 as a coding/decoding method used in the first layer coding section and the first layer decoding section.

In addition, with the above-described Embodiments 4 to 6, a case has been described where information obtained in the first layer coding section (the decoded spectrum of the TDAC parameters obtained in TDAC coding section 287) is used as the first layer decoded spectrum. However, the present invention is not limited to this, and equally applicable to a case in which other information calculated in the first layer coding section used as the first layer decoded spectrum. Moreover, the present invention is equally applicable to a case in which processing such as orthogonal transform is performed on the first layer decoded signal resulting from decoding first layer encoded information and the calculated spectrum is used as the first layer decoded spectrum. That is, the present invention is not limited to characteristics of the first layer decoded spectrum but allows the same effect as in a case in which parameters calculated in the first layer coding section or all spectrums calculated from a decoded signal obtained by decoding first layer decoded information are used as the first layer decoded spectrum.

In addition, with the above-described Embodiments 4 to 6, a case has been described as an example where the search range set for part of subbands (the first subband, the third subband and the fifth subband in the present embodiment) varies per subband. However, the present invention is not limited to this, a common search range may be set for all subbands or part of subbands.

Each embodiment of the present invention has been explained.

Here, with each of the above-described embodiments, a case has been explained as an example where, after the most similar part to each subband $SB_p$(p=0, . . . , P−1) is searched in the first layer decoded spectrum, gain coding section 265 encodes the amount of difference in the spectral power from an input spectrum for each subband. However, the present invention is not limited to this, and gain coding section 265 may encode the ideal gain corresponding to optimal pitch coefficient $T_p'$ calculated in search for section 263. In this case, the subband structure of a gain encoded in gain coding section 265 is preferably the same as the subband structure at the time of filtering. By this configuration, it is possible to generate an estimated spectrum similar to the higher frequency band of an input spectrum and reduce noise contained in the decoded signal.

In addition, with each of the above-described embodiments, although a case has been described as an example where a second layer decoded signal is an output signal in the decoding side at all times, the present invention is not limited to this and the second layer decoded signal may be changed to the first layer decoded signal as an output signal. For example, when part of encoded information is lost in a transmission channel or there is a transmission error in encoded information, it may be possible to obtain only the decoded signal decoded in the first layer. In this case, the first layer decoded signal is outputted as an output signal.

In addition, with each of the above-described embodiments, although scalable coding apparatus/decoding apparatus each composed of two hierarchies as a coding apparatus and a decoding apparatus have been described as examples, the present invention is not limited to this, and scalable coding apparatus/decoding apparatus each composed of three hierarchies or more may be possible.

Moreover, with each of the above-described embodiments, a case has been described where pitch coefficient setting sections 264 and 267 set a common range "SEARCH" for each subband to use to search for the optimal pitch coefficient for each subband. However, the present invention is not limited to this and the search range may be set separately for each subband as $SEARCH_p$(p=0, . . . , P−1). For example, in the higher frequency band, the search range for a subband near the lower frequency band is set wider, and the search range for a higher frequency subband in a higher frequency band is set narrower, so that it is possible to allow flexible bit allocation depending on frequency bands.

Moreover, with each of the above-described embodiments, a configuration has been described where pitch coefficient setting sections 264, 274, 294, 404 and 414 set a common range "SEARCH" for each subband to use to search for the optimal pitch coefficient for each subband, and the pitch coefficient search range is around the position adding the bandwidth of the previous neighboring subband to the optimal pitch coefficient of the previous neighboring subband (the range of ±SEARCH). However, the present invention is not limited to this but is equally applicable to a configuration in which the range to search for an optimal pitch coefficient is asymmetric to the position obtained by adding the bandwidth of the previous neighboring subband to the optimal pitch coefficient of the previous neighboring subband. For example, a method of setting a search range is possible that the search range in the lower frequency band side from the position obtained by adding the bandwidth of the previous neighboring subband to the optimal pitch coefficient of the previous neighboring subband is set wider and the search range in the high frequency band side is set narrower. By this configuration, it is possible to reduce a tendency to bias the search range of an optimal pitch coefficient excessively toward the higher frequency band side, so that it is possible to improve the quality of a decoded signal.

In addition, with each of the above-described embodiments, a configuration has been described where the range to search for the optimal pitch coefficient is set for some subband based on the optimal pitch coefficient of the previous neighboring subband. This method uses correlation between optimal pitch coefficients on the frequency domain. However, the present invention is not limited to this but is applicable to a case in which correlation between optimal pitch coefficients on the time domain is used. To be more specific, based on the range to search for optimal pitch coefficients for frames processed earlier (e.g. past three frames), the range to search for an optimal pitch coefficient is set around that range. In this case, search is performed around the location calculated by four-dimensional linear prediction. In addition, it is possible to combine the above-described correlation in the time domain and the correlation in the frequency domain described in each of the above-described embodiments. In this case, the range to search for the optimal pitch coefficient is set for a certain subband based on the optimal pitch coefficient searched in a past frame and the optimal pitch coefficient searched with respect to the previous neighboring subband. In addition, when the range to search for an optimal pitch coefficient is set using correlation in the time domain, there is a problem of propagation of a transmission error. This problem can be solved by providing a frame to set ranges to search for optimal pitch coefficients not based on correlation in the time domain after setting a certain number of ranges to search for optimal pitch coefficients consecutively based on correlation in the time domain (for example, a frame to set a search range not using correlation in the time domain is provided every time four frames are processed.

Moreover, the coding apparatus, the decoding apparatus and the method thereof are not limited to each of the above-described embodiments but may be practiced with various modifications. For example, each embodiment may be appropriately combined and practiced.

Moreover, with each of the above-described embodiments, although the decoding apparatus performs processing using encoded information transmitted from the coding apparatus according to each of the above-described embodiments, the present invention is not limited to this but processing is allowed if encoded information from the coding apparatus according to each of the above-described embodiment is not necessarily used, as far as the encoded information includes necessary parameters or data.

Moreover, the present invention is applicable to a case in which a signal processing program is written to a machine readable recoding medium such as a memory, a disc, a tape, a CD and a DVD to perform operations, and it is possible to provide the same effect as in embodiments of the present invention.

Moreover, although cases have been described with the embodiments above where the present invention is configured by hardware, the present invention may be implemented by software.

Each function block employed in the description of the aforementioned embodiments may typically be implemented as an LSI constituted by an integrated circuit. These may be individual chips or partially or totally contained on a single chip. "LSI" is adopted here but this may also be referred to as "IC," "system LSI," "super LSI" or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells within an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2008-66202, filed on Mar. 14, 2008, Japanese Patent Application No. 2008-143963, filed on May 30, 2008 and Japanese Patent Application No. 2008-298091, filed on Nov. 21, 2008, including the specifications, drawings and abstracts, are incorporated herein by reference in their entirety.

Industrial Applicability

The coding apparatus, the decoding apparatus and the method thereof make possible to improve the quality of a decoded signal when the spectrum of a higher frequency band is estimated by performing band extension using the spectrum of a lower frequency band, and are applicable to, for example, a packet communication system, a mobile communication system and so forth.

The invention claimed is:

1. A coding apparatus comprising:

a first encoder that encodes a low frequency band of an input speech/sound signal equal to or lower than a predetermined frequency to generate first encoded information;

a decoder that decodes the first encoded information to generate a decoded signal; and a second encoder that generates second encoded information by dividing a high frequency band of the input speech/sound signal, higher than the predetermined frequency, into a plurality of subbands and estimating each of the plurality of subbands based on the input speech/sound signal or the decoded signal, using an estimation result from a neighboring subband.

2. The coding apparatus according to claim 1, wherein:

the second encoder includes:

a divider that divides the high frequency band of the input speech/sound signal into N subbands and obtains a start position and a bandwidth of each of the N subbands as band division information, where N is an integer greater than 1;

a filter that generates N n-th estimated signals from a first estimated signal to an n-th estimated signal by filtering the decoded signal, where n=1,2, . . . , N;

a setting processor that sets a pitch coefficient used in the filter by changing the pitch coefficient;

a searching processor that searches for an n-th optimal pitch coefficient to maximize a degree of similarity between the n-th estimated signal and an n-th subband; and a multiplexer that provides the second encoded information by multiplexing N optimal pitch coefficients from a first optimal pitch coefficient to an n-th optimal pitch coefficient with the band division information, and the setting processor sets a pitch coefficient used in the filter in order to estimate a first subband by changing the pitch coefficient in a predetermined range and sets pitch coefficients used in the filter in order to estimate m-th subbands subsequent to a second subband by changing the pitch coefficient in a range corresponding to an (m-1)-th optimal pitch coefficient or in the predetermined range, where m=2, 3, . . . , N.

3. The coding apparatus according to claim 2, wherein the setting processor sets the pitch coefficients such that a range corresponding to the (m-1)-th optimal pitch coefficient is within a predetermined width including the (m-1)-th optimal pitch coefficient.

4. The coding apparatus according to claim 2, wherein the setting processor sets the pitch coefficients such that a range corresponding to the (m-1)-th optimal pitch coefficient is within a predetermined width including a pitch coefficient resulting from adding a bandwidth of the (m-1)-th subband to the (m-1)-th optimal pitch coefficient.

5. The coding apparatus according to claim 2, wherein the setting processor sets the pitch coefficient used in the filter in order to estimate each of all m-th subbands subsequent to the second subband by changing the pitch coefficient in a range corresponding to the (m-1)-th optimal pitch coefficient.

6. The coding apparatus according to claim 2, wherein:

in order to estimate every a predetermined number of m-th subbands subsequent to the second subband, the setting processor sets the pitch coefficients used in the filter by changing each pitch coefficient in the predetermined range; and in order to estimate other m-th subbands, the setting processor sets the pitch coefficients used in the filter by changing each pitch coefficient in the range corresponding to the (m-1)-th optimal pitch coefficient.

7. The coding apparatus according to claim 2, wherein the setting processor sets the pitch coefficients of the plurality of subbands such that a range for a higher frequency subband is set in a lower frequency band of the decoded signal.

8. The coding apparatus according to claim 2, wherein the setting processor sets the pitch coefficients of the plurality of subbands such that a range for a higher frequency subband is set in a higher frequency band of the decoded signal.

9. The coding apparatus according to claim 2, further comprising a determining processor that calculates a correlation between the m-th subband and the (m-1)-th subband as an m-th correlation and determines whether or not each of N-1 m-th correlations is equal to or higher than a predetermined level, wherein:

in order to estimate the m-th subband determined in the determining processor that the m-th correlation is in a level equal to or higher than the predetermined level, the setting processor sets the pitch coefficient used in the filter by changing the pitch coefficient in the range corresponding to the (m-1)-th optimal pitch coefficient; and in order to estimate the m-th subband determined in the determining processor that the m-th correlation is lower than the predetermine level, the setting processor sets the pitch coefficient used in the filter by changing the pitch coefficient in the predetermined range.

10. The coding apparatus according to claim 9, wherein the determining processor calculates a spectral flatness measure for each of the N subbands and calculates a reciprocal of an absolute value of a difference or ratio in the spectral flatness measure between the m-th subband and the (m-1)-th subband.

11. The coding apparatus according to claim 9, wherein the determining processor calculates an energy of each of the N subbands and calculates a reciprocal of an absolute value of a difference or ratio in the energy between the m-th subband and the (m-1)-th subband.

12. The coding apparatus according to claim 2, further comprising a determining processor that calculates a correlation between the m-th subband and the (m-1)-th subband as an m-th correlation and determines whether or not a number of m-th correlations in a level equal to or higher than a predetermined level among N-1 m-th correlations is equal to or greater than a predetermined number, wherein:

when determining processor determines that the number of the m-th correlations is equal to or greater than the predetermined number, the setting processor sets the pitch coefficients used in the filter in order to estimate each of all the m-th subbands subsequent to the second subband by changing the pitch coefficient in the range corresponding to the (m-1)-th optimal pitch coefficient; and when determining processor determines that the number of the m-th correlations in a level equal to or higher than the predetermined level is smaller than the predetermined number, the setting processor sets the pitch coefficients used in the filter in order to estimate each of all the m-th subbands subsequent to the second subband by changing the pitch coefficient in the predetermined range.

13. The coding apparatus according to claim 2, wherein the setting processor compares a value of the (m-1)-th optimal pitch coefficient with a preset threshold and increases or decreases a number of entries at a time of searching for the pitch coefficient used in the filter in order to estimate the m-th subband.

14. The coding apparatus according to claim 2, wherein the setting processor compares a value of the (m-1)-th optimal pitch coefficient with a preset threshold and changes a method of setting the pitch coefficient used in the filter in order to estimate the m-th subband based on a comparison result.

15. The coding apparatus according to claim 14, wherein the setting processor switches between a setting method of changing in the predetermined range and a setting method of changing in the range corresponding to the (m-1)-th optimal pitch coefficient.

16. A communication terminal apparatus including a coding apparatus according to claim 1.

17. A base station apparatus including a coding apparatus according to claim 1.

18. A decoding apparatus comprising:

a receiver that receives first encoded information generated in a coding apparatus and obtained by encoding a low frequency band of an input speech/sound signal equal to or lower than a predetermined frequency and second encoded information obtained by dividing a high frequency band of the input speech/sound signal higher than the predetermined frequency into a plurality of subbands and estimating each of the plurality of subbands based on the input speech/sound signal or a first decoded signal obtained by decoding the first encoded information using an estimation result in a neighboring subband;

a first decoder that decodes the first encoded information to generate a second decoded signal; and a second decoder that generates a third decoded signal by estimating the high frequency band of the input speech/sound signal based on the second decoded signal, using the decoded result in the neighboring subband obtained by using the second encoded information.

19. A communication terminal apparatus including a decoding apparatus according to claim 18.

20. A base station apparatus including a decoding apparatus according to claim 18.

21. A coding method performed by a processor, comprising:

encoding a low frequency band of an input speech/sound signal equal to or lower than a predetermined frequency to generate first encoded information;

decoding the first encoded information to generate a decoded signal; and generating second encoded information by dividing a high frequency band of the input speech/sound signal higher than the predetermined frequency into a plurality of subbands and estimating each of the plurality of subbands based on the input speech/sound signal or the decoded signal, using an estimation result in a neighboring subband.

22. A decoding method performed by a processor, comprising:

receiving first encoded information that is generated in a coding apparatus and obtained by encoding a low frequency band of an input speech/sound signal lower than a predetermined frequency and second encoded information that is obtained by dividing a high frequency band of the input speech/sound signal higher than the predetermined frequency into a plurality of subbands and estimating each of the plurality of subbands based on the input speech/sound signal or a first decoded signal obtained by decoding the first encoded information, using an estimation result in a neighboring subband;

decoding the first encoded information to generate a second decoded signal; and generating a third decoded signal by estimating the high frequency band of the input signal based on the second decoded signal, using a decoded result in the neighboring subband obtained by using the second encoded information.

* * * * *